US009808102B2

(12) United States Patent
Pinelli

(10) Patent No.: US 9,808,102 B2
(45) Date of Patent: Nov. 7, 2017

(54) TRAVEL CONTAINER HAVING DRINKING ORIFICE AND VENT APERTURE

(71) Applicant: IGNITE USA, LLC, Chicago, IL (US)

(72) Inventor: Steven N. Pinelli, Gary, IN (US)

(73) Assignee: IGNITE USA, LLC, Chicago, IL (US)

( * ) Notice: Subject to any disclaimer, the term of this patent is extended or adjusted under 35 U.S.C. 154(b) by 0 days.

(21) Appl. No.: 15/192,893

(22) Filed: Jun. 24, 2016

(65) Prior Publication Data

US 2016/0302599 A1 Oct. 20, 2016

Related U.S. Application Data

(63) Continuation of application No. 14/815,850, filed on Jul. 31, 2015, now Pat. No. 9,398,823, which is a continuation of application No. 14/089,467, filed on Nov. 25, 2013, now Pat. No. 9,095,233, which is a continuation of application No. 13/206,121, filed on (Continued)

(51) Int. Cl.

| | |
|---|---|
| ***A47G 19/22*** | (2006.01) |
| ***B65D 43/02*** | (2006.01) |
| ***B65D 43/20*** | (2006.01) |
| ***B65D 43/26*** | (2006.01) |

(Continued)

(52) U.S. Cl.

CPC ..... *A47G 19/2272* (2013.01); *B65D 43/02* (2013.01); *B65D 43/20* (2013.01); *B65D 43/26* (2013.01); *B65D 47/32* (2013.01); *B65D 51/18* (2013.01); *B65D 2251/009* (2013.01); *B65D 2251/0018* (2013.01); *B65D 2251/0028* (2013.01); *B65D 2251/0081* (2013.01); *B65D 2543/00046* (2013.01)

(58) Field of Classification Search

CPC ..... A47G 19/2255; A47G 19/2272; A47G 19/2266; B65D 47/32; B65D 47/28; B65D 47/26; B65D 47/20; B65D 43/02; B65D 43/20; B65D 43/26; B65D 51/18

USPC .... 220/715, 714, 713, 711, 367.1, 368, 373, 220/361, 378, 262, 254.1, 716, 281, 756, 220/710.5, 260, 211, 259.5, 254.9, 703, 220/200; 215/387, DIG. 7, 315, 311, 215/307, 295; 222/481.5, 484, 559, 477, 222/470, 481, 483, 505, 506, 471, 472; D9/449, 447, 435; D7/312, 300, 321

See application file for complete search history.

(56) References Cited

U.S. PATENT DOCUMENTS

| | | | |
|---|---|---|---|
| 830,142 | A | 9/1906 | Ebbing |
| 1,072,588 | A | 9/1913 | Duncan |

(Continued)

OTHER PUBLICATIONS

Petition for Inter Partes Review of U.S. Pat. No. 8,590,731, as filed with the USPTO dated Jul. 25, 2016.

(Continued)

*Primary Examiner* — Robert J Hicks

(74) *Attorney, Agent, or Firm* — Marshall, Gerstein & Borun LLP

(57) ABSTRACT

A container is provided with a lid having a push-button trigger mechanism that operates both a drink seal for a drinking opening and a vent seal for a vent opening. The trigger translates in a straight line transverse to a longitudinal axis of the container body during the entire movement of the trigger to define a straight-line actuation stroke. The vent opening is initially opened during a first portion of the actuation stroke of the trigger, and the drink opening is initially opened during a second portion of the actuation stroke of the trigger.

13 Claims, 16 Drawing Sheets

Related U.S. Application Data

Aug. 9, 2011, now Pat. No. 8,590,731, which is a continuation of application No. 12/456,192, filed on Jun. 12, 2009, now Pat. No. 7,997,442, which is a continuation of application No. 11/698,797, filed on Jan. 26, 2007, now Pat. No. 7,546,933, which is a continuation-in-part of application No. 11/384,165, filed on Mar. 17, 2006, now abandoned.

(60) Provisional application No. 60/663,280, filed on Mar. 18, 2005.

(51) Int. Cl.
*B65D 47/32* (2006.01)
*B65D 51/18* (2006.01)

(56) References Cited

U.S. PATENT DOCUMENTS 2,193,232 A 3/1940 Hacmac
2,447,870 A 8/1948 Polcyn
2,622,420 A 12/1952 Rice
2,799,437 A 7/1957 Jepson
3,059,816 A 10/1962 Goldstein
3,635,380 A 1/1972 Fitzgerald
3,739,938 A 6/1973 Paz
3,964,631 A 6/1976 Albert
3,967,748 A 7/1976 Albert
3,972,443 A 8/1976 Albert
4,094,433 A 6/1978 Numbers
4,099,642 A 7/1978 Nergard
4,133,446 A 1/1979 Albert
4,136,799 A 1/1979 Albert
4,171,060 A 10/1979 Howard et al.
4,212,408 A 7/1980 Valenzona
4,276,992 A 7/1981 Susich
4,303,173 A 12/1981 Nergard
D288,667 S 3/1987 Miner
4,686,725 A 8/1987 Mitchell
4,706,313 A 11/1987 Murphy
4,711,372 A 12/1987 Gach
4,712,704 A 12/1987 Ramsey et al.
4,779,766 A 10/1988 Kinsley
4,801,053 A 1/1989 Kaster
4,881,668 A 11/1989 Kitterman et al.
4,901,387 A 2/1990 Luke
D315,872 S 4/1991 Bixler
5,025,519 A 6/1991 Spann et al.
5,039,158 A 8/1991 Maier
5,070,560 A 12/1991 Wilkinson
5,082,134 A 1/1992 Ramsey
5,118,014 A 6/1992 Hestehave et al.
5,153,977 A 10/1992 Toida et al.
5,163,196 A 11/1992 Graebe et al.
5,169,016 A 12/1992 Hinz, Jr.
5,179,742 A 1/1993 Oberle
5,186,353 A 2/1993 Ramsey
5,199,597 A 4/1993 Gladish
5,222,623 A 6/1993 Eger et al.
5,244,113 A 9/1993 Stymiest
5,249,703 A 10/1993 Karp
5,252,278 A 10/1993 Spann et al.
5,307,950 A 5/1994 Li
D355,322 S 2/1995 Ackley et al.
5,412,821 A 5/1995 Wilkinson
5,427,271 A 6/1995 Wang
5,461,741 A 10/1995 Graebe
5,462,185 A 10/1995 Walker, III
5,465,866 A 11/1995 Belcastro
5,477,980 A 12/1995 Chaffin
5,485,938 A 1/1996 Boersma
D367,611 S 3/1996 Wagner, III et al.
D373,927 S 9/1996 Kramer et al.
5,570,797 A 11/1996 Yeh
5,573,139 A 11/1996 Yeh
5,580,504 A 12/1996 Spann et al.
5,586,346 A 12/1996 Stacy et al.
5,596,781 A 1/1997 Graebe
5,606,754 A 3/1997 Hand et al.
5,630,238 A 5/1997 Weismiller et al.
5,649,331 A 7/1997 Wilkinson et al.
5,652,985 A 8/1997 Wilkinson et al.
5,666,681 A 9/1997 Meyer et al.
5,680,951 A 10/1997 Feltman, III et al.
5,689,845 A 11/1997 Sobieralski
D386,948 S 12/1997 Wissinger
5,711,452 A 1/1998 Chaffin
5,753,289 A 5/1998 Ness
D394,778 S 6/1998 Arns et al.
D397,905 S 9/1998 Hsu
5,845,352 A 12/1998 Matsler et al.
D404,613 S 1/1999 Hatsumoto et al.
D406,006 S 2/1999 Hatsumoto et al.
D408,221 S 4/1999 Asberg
D416,755 S 11/1999 Trombly
5,987,668 A 11/1999 Ackley
D417,360 S 12/1999 Bickert et al.
6,010,029 A 1/2000 Wang
6,036,271 A 3/2000 Wilkinson et al.
6,053,474 A 4/2000 Stucke, Jr. et al.
6,098,834 A 8/2000 Hatsumoto et al.
6,102,244 A 8/2000 Kuwano et al.
6,116,476 A 9/2000 Huang
6,119,291 A 9/2000 Osborne et al.
6,126,035 A 10/2000 Schaper et al.
6,158,608 A 12/2000 Schlattl
RE37,016 E 1/2001 Morano
D437,229 S 2/2001 Andrew
6,223,369 B1 5/2001 Maier et al.
6,276,560 B1 8/2001 Belcastro
D447,693 S 9/2001 Warner et al.
6,324,709 B1 12/2001 Ikeda et al.
6,351,863 B1 3/2002 Meyer et al.
6,352,166 B1 3/2002 Copeland
6,401,990 B1 6/2002 Walters et al.
D460,894 S 7/2002 Ziegenfus et al.
6,443,325 B1 9/2002 Schaper et al.
6,471,085 B1 10/2002 Gallo
D470,009 S 2/2003 Turchi et al.
D471,808 S 3/2003 de Castro Couto
6,557,717 B1 5/2003 Keck
6,623,080 B2 9/2003 Clapper
6,644,490 B2 11/2003 Clarke
6,679,397 B2 1/2004 Smith et al.
6,701,556 B2 3/2004 Romano et al.
6,702,137 B1 3/2004 Kowa et al.
6,732,875 B2 5/2004 Smith et al.
6,732,876 B2 5/2004 Belcastro
6,732,964 B2 5/2004 Couchey
6,763,964 B1 7/2004 Hurlbut et al.
6,782,574 B2 8/2004 Totton et al.
6,854,615 B2 2/2005 von Ronn et al.
D502,844 S 3/2005 Rohe
6,874,185 B1 4/2005 Phillips et al.
6,901,617 B2 6/2005 Sprouse, II et al.
D508,185 S 8/2005 Gauss
6,922,863 B2 8/2005 Giori et al.
6,928,681 B1 8/2005 Stacy
6,952,852 B2 10/2005 Reeder et al.
6,976,281 B2 12/2005 Schunk et al.
6,978,910 B2 12/2005 Sanders et al.
D513,452 S 1/2006 Parve
7,011,227 B2 3/2006 Ward et al.
D522,794 S 6/2006 Imai
D523,340 S 6/2006 Westphal
7,073,678 B1 7/2006 Dibdin et al.
D526,898 S 8/2006 Isono et al.
D526,899 S 8/2006 Mangin et al.
7,086,107 B2 8/2006 Ellis et al.
D529,761 S 10/2006 Trombly
D533,064 S 12/2006 Glynn et al.
7,195,137 B2 3/2007 Belcastro
D540,625 S 4/2007 Sandberg
7,201,288 B2 4/2007 von Ronn et al.

(56) References Cited

U.S. PATENT DOCUMENTS

| | | | |
|---|---|---|---|
| D541,572 | S | 5/2007 | Watanabe |
| D544,300 | S | 6/2007 | Tien |
| 7,229,134 | B2 | 6/2007 | Ito |
| D547,122 | S | 7/2007 | Gluck |
| D547,611 | S | 7/2007 | Seum et al. |
| D548,008 | S | 8/2007 | Lin |
| D548,508 | S | 8/2007 | Tonelli |
| D552,990 | S | 10/2007 | Vogel |
| D554,433 | S | 11/2007 | Gluck |
| D554,992 | S | 11/2007 | Mangin et al. |
| D555,000 | S | 11/2007 | Bunce et al. |
| D555,514 | S | 11/2007 | Munn |
| D555,970 | S | 11/2007 | Schreitmueller et al. |
| D558,111 | S | 12/2007 | Banks, III |
| D560,435 | S | 1/2008 | Meehan |
| D564,840 | S | 3/2008 | Williams |
| D564,841 | S | 3/2008 | Clemens et al. |
| D564,874 | S | 3/2008 | Mangin et al. |
| D569,182 | S | 5/2008 | Homma |
| D572,531 | S | 7/2008 | Romandy et al. |
| D573,404 | S | 7/2008 | Wahl |
| 7,413,096 | B2 | 8/2008 | Morgan et al. |
| D577,582 | S | 9/2008 | Walsh et al. |
| D577,958 | S | 10/2008 | Homma |
| D581,727 | S | 12/2008 | Pinelli et al. |
| D584,107 | S | 1/2009 | George |
| D587,060 | S | 2/2009 | Tong Chi Chung |
| D587,969 | S | 3/2009 | Gilbert |
| D588,411 | S | 3/2009 | Watanabe |
| D589,750 | S | 4/2009 | Liu et al. |
| D592,012 | S | 5/2009 | Carreno |
| D592,456 | S | 5/2009 | Pinelli et al. |
| D592,905 | S | 5/2009 | Pinelli et al. |
| D592,913 | S | 5/2009 | Pinelli et al. |
| 7,546,933 | B2 | 6/2009 | Pinelli |
| D611,764 | S | 3/2010 | Wahl et al. |
| D623,473 | S | 9/2010 | Chen |
| D623,474 | S | 9/2010 | Carlson et al. |
| D623,476 | S | 9/2010 | Carlson et al. |
| D629,653 | S | 12/2010 | Gullickson et al. |
| D634,161 | S | 3/2011 | Roth et al. |
| RE42,484 | E | 6/2011 | Kitamura et al. |
| D640,094 | S | 6/2011 | Carlson et al. |
| 7,997,442 | B2 | 8/2011 | Pinelli |
| D648,985 | S | 11/2011 | Chiu et al. |
| D656,787 | S | 4/2012 | Phillips et al. |
| D658,443 | S | 5/2012 | Chiu et al. |
| 2003/0071041 | A1 | 4/2003 | Vogel |
| 2005/0028289 | A1 | 2/2005 | Hakamiun |
| 2006/0043091 | A1 | 3/2006 | Pinelli et al. |
| 2006/0226160 | A1 | 10/2006 | Elsaden et al. |

OTHER PUBLICATIONS

Petition for Inter Partes Review of U.S. Pat. No. 9,095,233, as filed with the USPTO dated Aug. 10, 2016.

Petition for Inter Partes Review of U.S. Pat. No. 7,997,442, as filed with the USPTO dated Mar. 31, 2014.

Declaration of Aron D. Dahlgren, P.E. in Support of Petition for Inter Partes Review of U.S. Pat. No. 7,997,442, as filed with the USPTO dated Mar. 31, 2014.

Patent Owner Ignite USA, LLC's Preliminary Response Under 35 U S C § 313 and 37 C.F.R §42.107, as filed with the USPTO dated Jul. 7, 2014.

Petition for Inter Partes Review of U.S. Pat. No. 7,546,933, as filed with the USPTO dated May 12, 2014.

Declaration of Aron D. Dahlgren, P,E., in Support of Petition for Inter Partes Review of U.S. Pat. No. 7,546,933, as filed with the USPTO dated May 12, 2014.

Patent Owner Ignite USA, LLC's Preliminary Response Under 35 U.S.C. § 313 and 37 C.F.R. §42.107, as filed with the USPTO dated Aug. 22, 2014.

Decision—Institution of Inter Partes Review entered Sep. 30, 2014, 37 C.F.R. §42.108, *Pacific Market International, LLC* v. *Ignite USA, LLC*, Case IPR2014-00561, U.S. Pat. No. 7,997,442.

Supplemental Declaration of Aron D. Dahlgren in Support of Petition for Inter Partes Review of U.S. Pat. No. 7,997,442, IPR2014-00561, as filed with the USPTO dated Nov. 6, 2014.

Patent Owner's Response, IPR2014-00561, as filed with the USPTO dated Feb. 6, 2015.

Declaration of Lee A. Swanger, Ph.D, P.E., IPR2014-00561, as filed with the USPTO dated Feb. 6, 2015.

DiDomenico, A., et al., "*Measurement and prediction of single and multi-digit finger strength*," Ergonomics, vol. 46, No. 15, pp. 1531-1548 (2003).

Johnson, Hope, "*Strength Capabilities and Subjective Limits for Repetitive Manual Insertion Tasks*," Ergonomics, 2003, vol. 46, No. 15, 1531-1548 (2001).

"*Human Strength Data Tables*," Ergonomics Center of North Carolina (2006).

Imrhan, S.N., et al., "*Trends in Finger Pinch Strength in Children, Adults, and the Elderly*," Human Factors, vol. 31, No. 6, pp. 689-701 (1989).

Li, Z., et al., "*Thumb force deficit after lower median nerve block*,"; J. NeuroEngineering and Rehab., vol. 1, No. 3 (2004).

Mathiowetz, V., et al., "*Grip and Pinch Strength: Normative Data for Adults*," Arch Phys Med Rehabil, vol. 66, pp. 69-74 (1985).

MIL-STD-1472F, Dept. Defense: Design Criteria Standard: Human Engineering (Aug. 23, 1999).

Peebles, Laura, et al., "*Pinch Strength*," ADULTDATA: The handbook of Adult Anthropometric and Strength Measurements—Data for Design Safety, Institute (1998).

Astin, Angela DiDomenico, "*Finger force capability: measurement and prediction using anthropometric and myoelectric measures*," Thesis submitted to the Faculty of the Virginia Polytechnic Institute and State University (Dec. 16, 1999).

Woodson, Wesley E., et al., "*Chapter 4, Human Factors Data: Human Strength*," Human Factors Design Handbook, Second Edition, McGraw-Hill, Inc., New York, pp. 610-625 (1992).

Deposition Transcript for Cross-Examination of Aron Dahlgren, vol. I, taken Jan. 7, 2015.

Deposition Transcript for Cross-Examination of Aron Dahlgren, vol. II, taken Jan. 8, 2015.

Petitioner's Reply U.S. Pat. No. 7,997,442, IPR2014-00561, as filed with the USPTO dated Apr. 2015.

Declaration of Aron D. Dahlgren in Support of Petitioner's Reply for Inter Partes Review of U.S. Pat. No. 7,997,442, IPR2014-00561, as filed with the USPTO dated Apr. 17, 2015.

Deposition Transcript of Lee Swanger, vol. I, taken Mar. 31, 2015.

Deposition Transcript of Lee Swanger, vol. II, taken Apr. 1, 2015.

Patent Owner's Motion to Exclude, IPR2014-00561, as filed with the USPTO dated May 14, 2015.

Deposition Transcript of Aron Dahlgren, vol. III, taken Apr. 29, 2015.

Deposition Transcript of Aron Dahlgren, vol. IV, taken Apr. 30, 2015.

Petitioner's Opposition to Patent Owner's Motion to Exclude, IPR2014-00561, as filed with the USPTO dated May 28, 2015.

Patent Owner's Reply in Support of Motion to Exclude, IPR2014-00561, as filed with the USPTO dated Jun. 3, 2015.

Final Written Decision IPR2014-00561, dated Sep. 28, 2015.

Decision—Institution of Inter Partes Review, U.S. Pat. No. 7,546,933, IPR2014-00750, dated Nov. 19, 2014.

Supplemental Declaration of Aron D. Dahlgren in Support of Petition for Inter Partes Review of U.S. Pat. No. 7,456,933, IPR2014-00750, as filed with the USPTO dated Dec. 9, 2014.

Patent Owner's Response, IPR2014-00750, as filed with the USPTO dated Feb. 18, 2015.

Declaration of Lee A. Swanger, Ph.D., P.E., IPR2014-00750, as filed with the USPTO dated Feb. 18, 2015.

Petitioner's Reply U.S. Pat. No. 7,546,933, IPR2014-00750, as filed with the USPTO dated Apr. 17, 2015.

Declaration of Aron D. Dahlgren in Support of Petitioner's Reply for Inter Partes Review of U.S. Pat. No. 7,456,933. IPR2014-00750, as filed with the USPTO dated Apr. 17, 2015.

(56) References Cited

OTHER PUBLICATIONS

Patent Owner's Motion to Exclude, IPR2014-00750, as filed with the USPTO dated May 14, 2015.
Petitioner's Opposition to Patent Owner's Motion to Exclude, IPR2014-00750, as filed with the USPTO dated May 28, 2015.
Patent Owner's Reply in Support of Motion to Exclude, IPR2014-00750, as filed with the USPTO dated Jun. 3, 2015.
Final Written Decision, IPR2014-00750, dated Nov. 13, 2015.
Defendant's Answer to First Amended Complaint and Counterclaims for Declaratory Judgment, filed Apr. 28, 2016, under Document No. 81, in Case No. 1:14-cv-00856 (N.D. Illinois), involving claims of infringement of U.S. Pat. No. 7,997,442.
Defendant's Answer to Complaint and Counterclaims for Declaratory Judgment, filed Jun. 10, 2016, under Document No. 18, in Case No. 1:16-cv-01930 (N.D. Illinois), involving claims of infringement of U.S. Pat. No. 8,590,731.
Defendant PMI's Final Invalidity and Unenforceability Contentions, *Ignite USA, LLC* v. *Pacific Market International, LLC*, Northern District of Illinois, 14-cv-856, Dec. 20, 2016 (15 pages).
Exhibit G, Defendant PMI's Final Invalidity and Unenforceability Contentions, *Ignite USA, LLC* v. *Pacific Market International, LLC*, Northern District of Illinois, 14-cv-856, Dec. 20, 2016 (10 pages).
Exhibit H, Defendant PMI's Final Invalidity and Unenforceability Contentions, *Ignite USA, LLC* v. *Pacific Market International, LLC*, Northern District of Illinois, 14-cv-856, Dec. 20, 2016 (10 pages).

514
690
733
16
610
665
732
668
520
696
695
694
699
697
685
708
518
683
644
737
731
735
804
822
820
812
813
808
728
729
727
710
824
826
802
828
821
800
806
667
683c
679
681
683b
677
683a
670
672
692

TRAVEL CONTAINER HAVING DRINKING ORIFICE AND VENT APERTURE

CROSS-REFERENCE TO RELATED APPLICATIONS

This application is a continuation of U.S. patent application Ser. No. 14/815,850, filed Jul. 31, 2015, which is a continuation of U.S. patent application Ser. No. 14/089,467, filed Nov. 25, 2013 and issued as U.S. Pat. No. 9,095,233 on Aug. 4, 2015, which is a continuation of U.S. patent application Ser. No. 13/206,121, filed on Aug. 9, 2011 and issued as U.S. Pat. No. 8,590,731 on Nov. 26, 2013, which is a continuation of U.S. patent application Ser. No. 12/456,192, filed Jun. 12, 2009 and issued as U.S. Pat. No. 7,997,442 on Aug. 16, 2011, which is a continuation of U.S. patent application Ser. No. 11/698,797, filed on Jan. 26, 2007 and issued as U.S. Pat. No. 7,546,933 on Jun. 16, 2009, which is a continuation-in-part of U.S. patent application Ser. No. 11/384,165, filed on Mar. 17, 2006 (now abandoned), which claims the priority benefit of U.S. Provisional Patent Application Ser. No. 60/663,280, filed on Mar. 18, 2005, all of which are expressly incorporated herein by reference and made a part hereof.

FEDERALLY SPONSORED RESEARCH OR DEVELOPMENT

Not Applicable.

TECHNICAL FIELD

The present invention relates generally to drinking containers, and more particularly to sealing mechanisms and trigger mechanisms for opening and closing orifices of drinking containers.

BACKGROUND OF THE INVENTION

Drinking containers, including travel mugs, are well known in the art. While such drinking containers according to the prior art provide a number of advantageous features, they nevertheless have certain limitations. The present invention seeks to overcome certain of these limitations and other drawbacks of the prior art, and to provide new features not heretofore available. A full discussion of the features and advantages of the present invention is deferred to the following detailed description, which proceeds with reference to the accompanying drawings.

SUMMARY OF THE INVENTION

The present invention generally provides a drinking container. According to one embodiment the drinking container has a container body and a lid removably covering a cavity of the drinking container. The lid has a plurality of apertures, closures for each of the apertures, and a trigger mechanism operates the various aperture closures.

According to another embodiment, the lid has a drink aperture and a separate vent aperture. Additionally, a shutter is provided to operably close and open access to the cavity of the container body through the drink aperture, and a vent seal is provided to operably close and open access to the cavity of the container body through the vent aperture.

According to another embodiment, the trigger mechanism is mechanically connected to the shutter and the vent seal. The trigger mechanism independently moves the shutter and the vent seal from a closed position to an open position, the shutter operating to operably close and open access to the cavity through the drink aperture, and the vent seal operating to operably close and open access to the cavity through the vent aperture.

According to another embodiment, the trigger mechanism has an actuation stroke. Preferably, the vent seal is initially actuated during a first portion of the actuation stroke of the trigger mechanism, and the shutter is initially actuated during a second portion of the actuation stroke of the trigger mechanism. Accordingly, a built-in delay is provided for opening the shutter to allow any internal pressure to be initially released through the vent aperture.

According to another embodiment, the shutter remains in a closed position during the first portion of the actuation stroke of the trigger.

According to another embodiment, a trigger of the trigger mechanism comprises a push-button actuated actuator extending from the lid. In one embodiment, actuation of a trigger button in a transverse direction to a longitudinal axis of the container body causes the shutter and the vent seal to transition to an open position.

According to another embodiment, the trigger can be transitioned from a first position to a second position. Preferably, the shutter and the vent seal are in the closed position when the trigger is in the first position, and the shutter and the vent seal are in the open position when the trigger is in the second position.

According to another embodiment, the shutter and the vent seal are normally positioned in the closed position. Accordingly, in this embodiment actuation of the trigger mechanism transitions the shutter and vent seal to the open position.

According to another embodiment, the drinking container has a vent chamber between the vent seal and the vent aperture. The vent chamber has a cross-sectional perimeter greater than a cross-sectional perimeter of the vent aperture. In one embodiment, the trigger extends partially through the vent chamber.

According to another embodiment, the drinking container has a vent aperture deflector plate. The deflector plate is provided adjacent the vent aperture and directs vapor being expelled out of the vent aperture transverse to a longitudinal axis of the container body.

According to another embodiment, the drinking container has a trigger seal opposing the vent seal. The trigger seal seals the joint between the trigger and an exterior of the lid.

According to another embodiment, the drinking container has a spring member exerting a force on the trigger to move the trigger from a second position, where the shutter and vent seal are open, to a first position, where the shutter and vent seal are closed.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
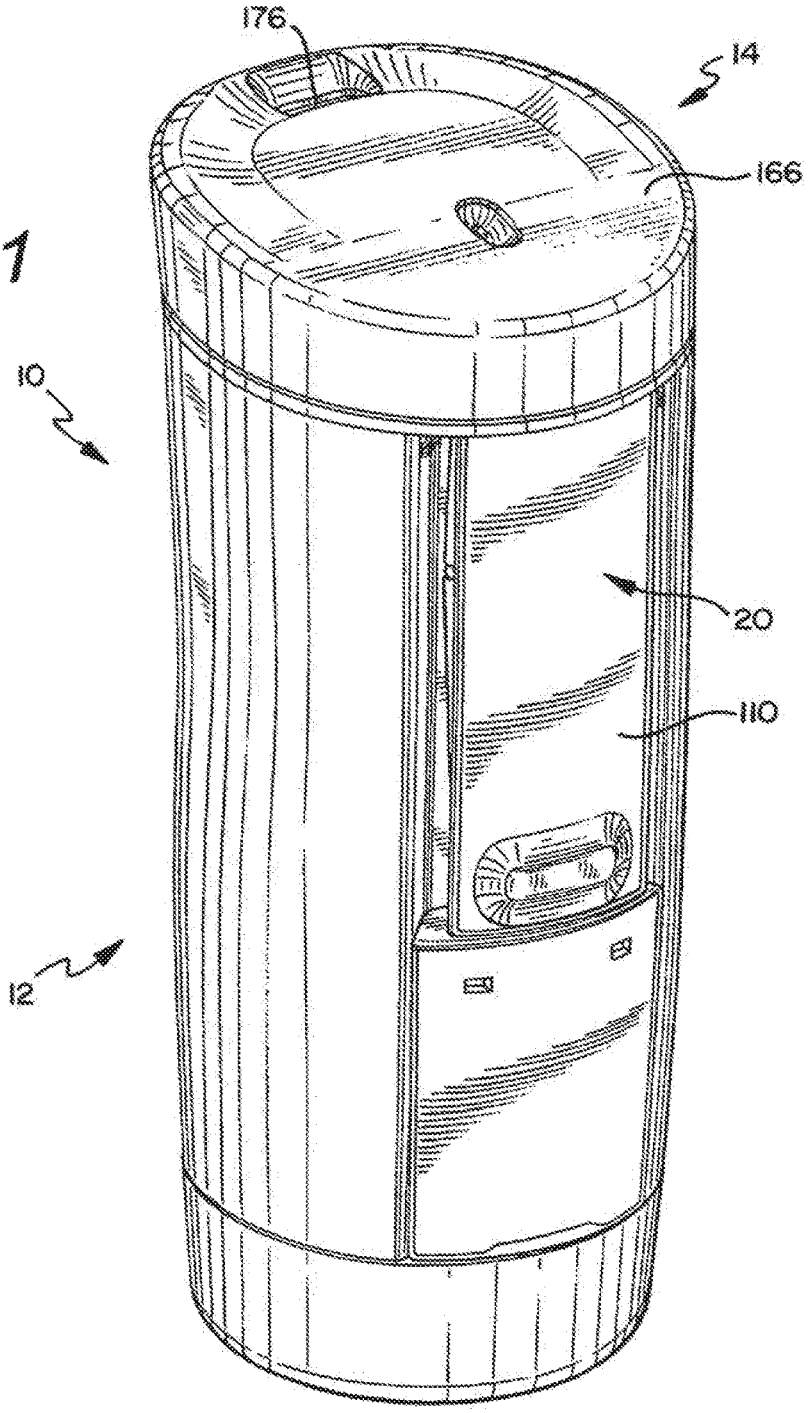
FIG. 1 is a front perspective view of one embodiment of an insulated drinking container.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
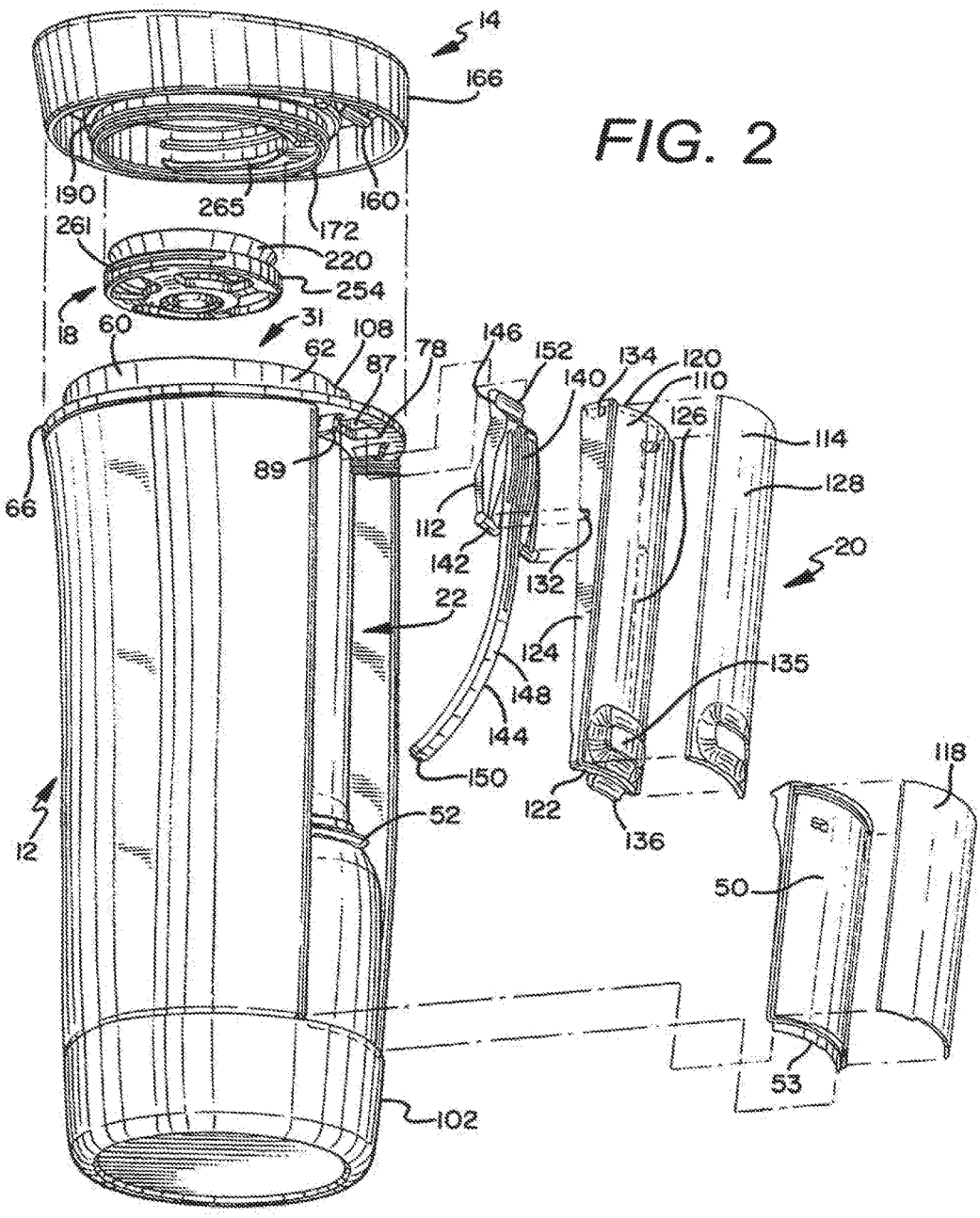
FIG. 2 is an exploded perspective view of one embodiment of an insulated drinking container.

Referring now to the Figures, and specifically to FIGS. 1 and 2, there is shown an insulated drinking container 10. The container 10 is generally comprised of a container body 12 for holding liquid, and a lid assembly 14 that can be secured to the container body 12. As explained in detail herein, the lid assembly 14 generally covers an opening of the liquid receptacle 16 in the drinking container 10. Additionally, in one embodiment a seal assembly 18 is provided and is preferably removably connected to the lid assembly 14. Also, a trigger assembly 20 is utilized to actuate the seal assembly 18 to provide for opening and closing one or more openings for allowing liquid to be dispelled from the liquid receptacle 16 of the drinking container 10. Further, in a preferred embodiment, the trigger assembly 20 is at least partially provided in a recess 22 in the container body 12.

Figure 7:
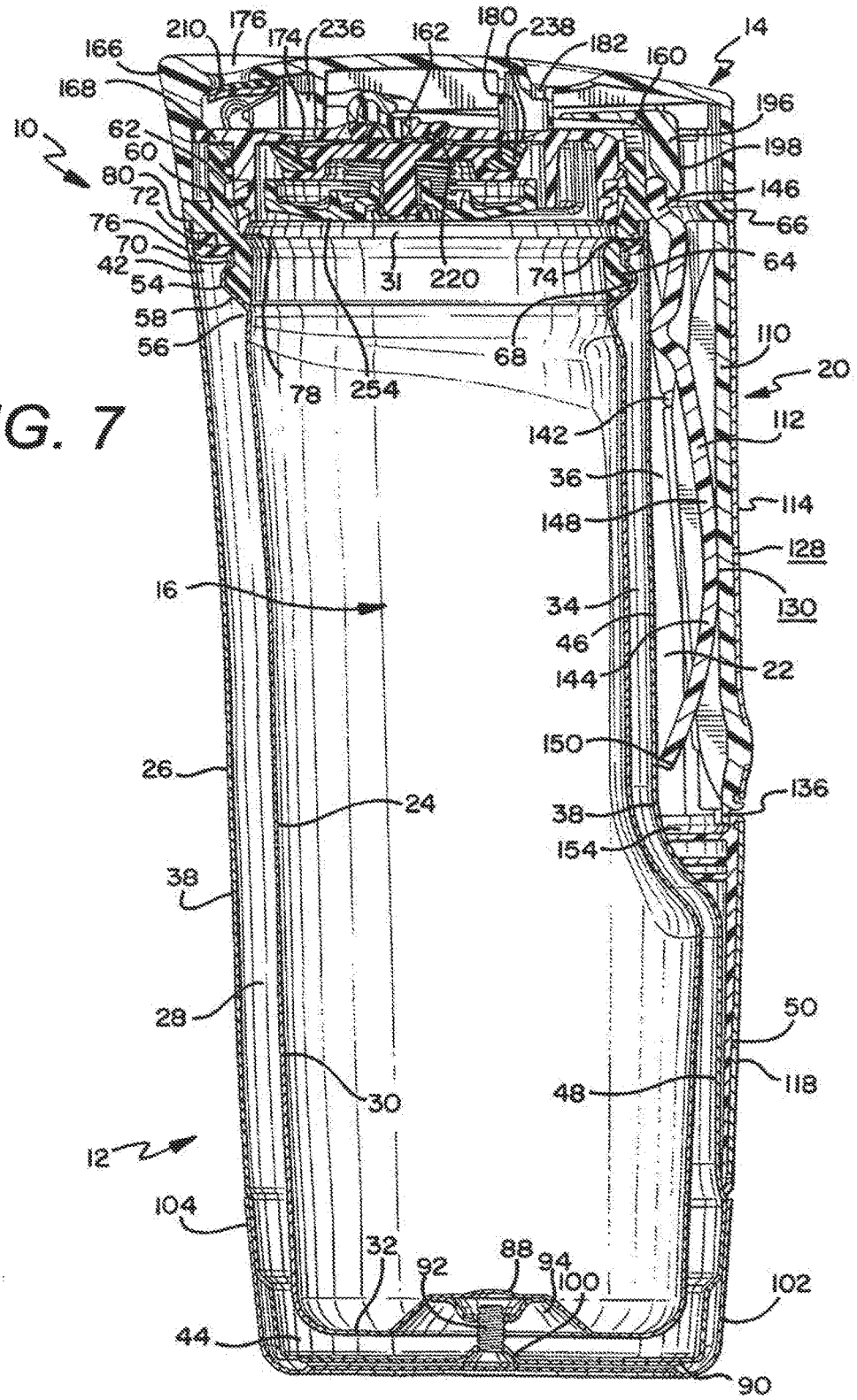
FIG. 7 is a cross-sectional side view about line 7-7 of the insulated drinking container of FIG. 5, with the sealing mechanism in the normal position.

As best shown in the exploded view of FIG. 2 and the cross-sectional view of FIG. 7, in one embodiment the container body 12 is formed of a dual-walled construction utilizing an inner wall component 24 and an outer wall component 26, and having a cavity 28 therebetween. Such a dual-walled construction can be insulated with an insulating foam provided in the cavity 28 or with a vacuum sealed construction to increase the thermal efficiency of the container 10. As shown in FIG. 7, in one embodiment, an insulating foam is inserted in the cavity 28 of the dual-walled container body 12 after the outer wall component 26 is connected to the inner wall component 24. Alternatively or additionally, a vacuum seal insulation technique may be employed utilizing traditional vacuum seal techniques to vacuum seal the cavity 28 of the container body 12. In a preferred embodiment, the inner wall component 24 and the outer wall component 26 are made of stainless steel material.

Figure 8:
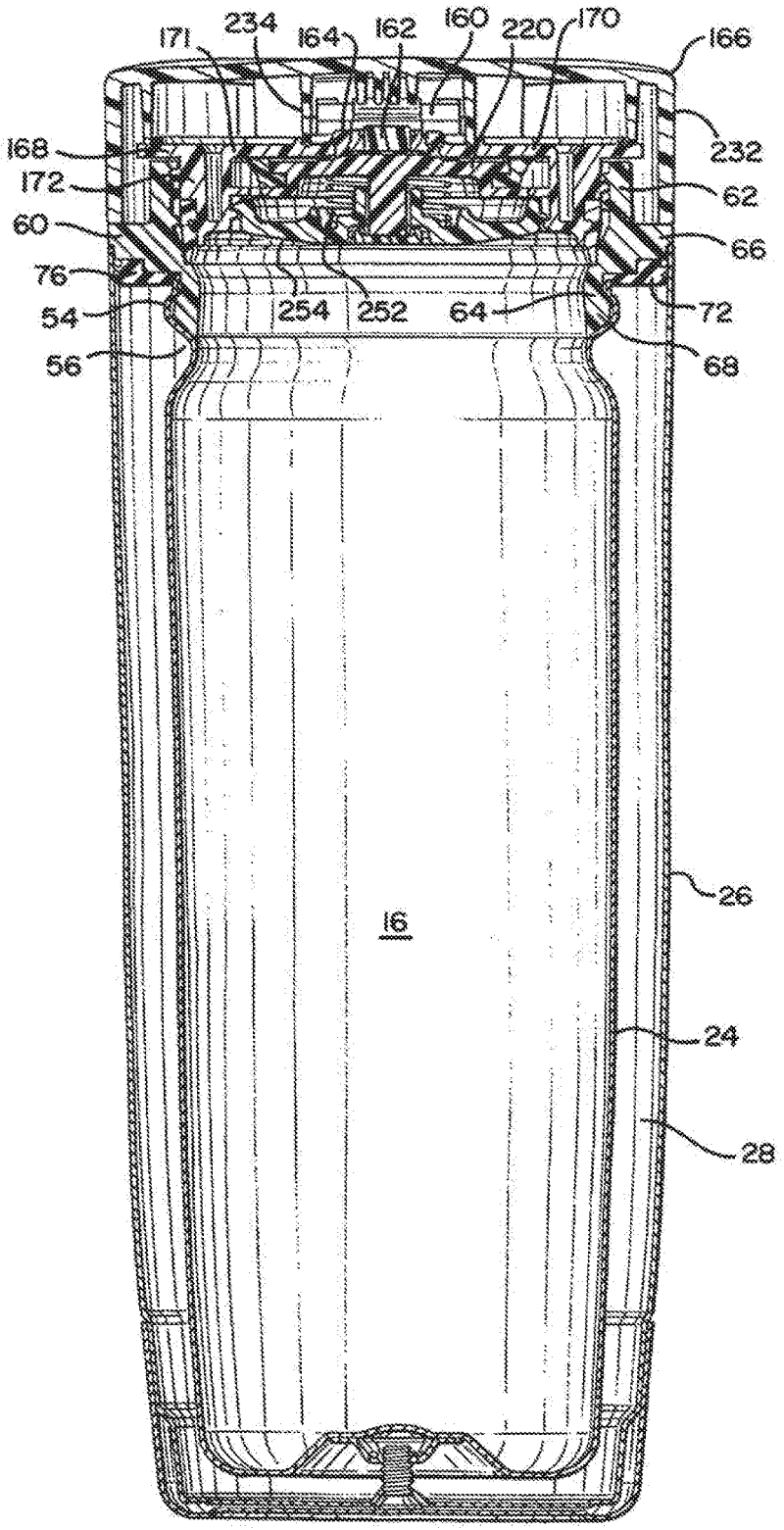
FIG. 8 is a cross-sectional side view about line 8-8 of the insulated drinking container of FIG. 5, with the sealing mechanism in the closed position.

Referring to FIGS. 2, 7 and 8, it can be seen that in one embodiment the inner wall component 24 has a sidewall 30 joining a bottom wall 32 to define the liquid receptacle 16 of the container 10. An opening 31 into the liquid receptacle 16 is provided at the end of the sidewall 30 opposing the bottom wall 32. Further, in one embodiment wherein the trigger assembly 20 is provided in the recess 22 in the container body 12, the sidewall 30 of the inner wall component 24 has a recess or depression 34 extending inwardly toward the liquid receptacle 16 (FIG. 7). The recess or depression 34 in the sidewall 30 of the inner wall component 24 of the preferred embodiment is longitudinal in shape to accept the preferred trigger assembly 20. Referring to FIGS. 7 and 8, it is shown that, except for the depression 34 in the sidewall 30, in one embodiment the sidewall 30 of the inner wall component 24 has a generally cylindrical shape.

As is explained herein, the outer wall component 26 also has a recess or depression 36 generally corresponding to the depression 34 in the inner wall component 24. It is understood that in such an embodiment it is not necessary that both the inner wall component 24 and outer wall component 26 have a depression 36 to create the recess 22 in the container body 12, however, to allow for preferred nesting of the depressions 34, 36 in the inner wall component 24 and outer wall component 26, which in at least one embodiment results in minimizing the thickness of the cavity 28 between the inner wall component 24 and outer wall component 26 and maximizing the volume of the liquid receptacle 16, such a configuration is preferred. As shown in FIGS. 2 and 7, the depression 34 in the inner wall component 24 in the preferred embodiment is longitudinal in shape, however it does not extend the entire length of the sidewall 30 of the inner wall component 24. Accordingly, the interior volume of the liquid receptacle 16 is maximized.

Referring again to FIGS. 2, 7 and 8, in one embodiment the outer wall component 26 is a generally cylindrical component, having a sidewall 38 and a hollow interior with openings at opposing ends of the sidewall. Further, in a preferred embodiment the outer wall component 26 has a cross-sectional geometry that changes from one end of the sidewall 38 to the opposing end of the sidewall 38 as the top portion of the outer wall component 26 has a flared aspect thereto. The outer wall component 26 has a first opening 42 provided at one end of the sidewall 38, and a second opening 44 provided at the other end of the sidewall 38. Additionally, in one embodiment wherein the trigger assembly 20 is provided in the recess 22 in the container body 12, the sidewall 38 of the outer wall component 26 has a recess or depression 36 extending radially inwardly from a perimeter of the sidewall 38 toward the hollow interior thereof. As explained above with respect to the inner wall component 24, the depression 36 in the outer wall component 26 of the preferred embodiment is longitudinal in shape to accept the preferred trigger assembly 20.

As shown in FIGS. 2 and 7, in one embodiment the depression 36 in the outer wall component 26 also has a first portion 46 and a second portion 48. The first portion 46 of the depression 36 is that which corresponds to the recess 22 for retaining a portion of the trigger assembly 20, whereas the second portion 48 corresponds to the recess for housing the body panel 50. Generally, the first portion 46 of the depression 36 is deeper than the second portion 48 of the depression 36. Additionally, as shown in the drawings, the first portion 46 of the depression 36 generally extends from the first opening 42 of the outer wall component 26, however, the second portion 48 of the depression generally does not extend fully to the second opening 44 in the outer wall component 26.

In one embodiment the body panel 50 serves a plurality of purposes, including providing a stop for the trigger assembly 20, providing a filler to fill the second portion 48 of the outer depression 36 to decrease cost and increase the ease of manufacturability of the outer wall component 26, and providing improved aesthetics for the container. The body panel 50 is generally fixed to the outer wall component 26 via a panel weldment 52 (see FIG. 2) extending from the depression 36 in the outer wall component 26. Because the body panel 50 is connected to the outer wall component 26 of the container 10 and within the longitudinal recess 22 thereof, the outer surface of the body panel 50 generally continues the generally cylindrical outer circumference of the lower portion of the container 10.

Referring again to the inner wall component 24 of the container body 12, in a preferred embodiment first and second circumferential rings 54, 56 are provided in the sidewall 30 adjacent the opening 31 to the liquid receptacle 16 (See FIGS. 7 and 8). The first circumferential ring 54 is located proximal the opening 31 and extends generally radially outwardly and can be described as being formed as an outward annular deboss in the inner wall component 24. The second circumferential ring 56 is located adjacent the first circumferential ring 54 and distal the opening 31 with respect to the first circumferential ring 54. The second circumferential ring 56 extends generally radially inwardly and can be described as being formed as an inward annular emboss in the inner wall component 24. In a preferred embodiment the first and second circumferential rings 54, 56 are positioned immediately adjacent one another, and a portion of the second circumferential ring 56 is an inward extension of a lower leg 58 of the first circumferential ring 54. As is explained herein, in a preferred embodiment the combination of the first and second circumferential rings 54, 56 in the inner wall component 24 assist in retaining the body insert 60 for securing the lid assembly 14 to the container body 12. It is understood by those of ordinary skill in the art, however, that additional means for retaining the body insert to the container body are possible without departing from the scope or spirit of the present invention.

As shown in FIGS. 2 and 7-8, the body insert 60 generally comprises a component that is fixed, typically permanently, to the inner wall component 24 of the container body 12 to assist in seating the inner wall component 24 with respect to the outer wall component 26, and to provide a connection point for securing the lid assembly 14 to the container body 12. In one embodiment the body insert 60 generally has an upper generally cylindrical portion 62, a lower generally cylindrical portion 64, and a flange 66 therebetween extending from a perimeter of the body insert 60. The lower generally cylindrical portion 64 has a shoulder 68 protruding radially outwardly from the generally cylindrical portion 64. The shoulder 68 is configured to mate with the first circumferential ring 54 in the inner wall component 24 of the container body 12 to assist in fixing the body insert 60 to the inner wall component 24.

In a preferred embodiment, the lower generally cylindrical portion 64 of the body insert 60 is preferably pressed through the opening 31 in the inner wall component 24 and partially into the liquid receptacle 16 of the inner wall component 24. As the body insert 60 is being pressed into its proper position the shoulder 68 on the lower generally cylindrical portion 64 will generally snap into place in the first circumferential ring 54. The second circumferential ring 56 engages a lower portion of the shoulder 68 to operate as stop, thereby assisting in properly seating the body insert 60 and preventing the body insert 60 from being inserted too far into the liquid receptacle 16. Further, an upper leg 70 of the first circumferential ring 54 engages an upper portion of the shoulder 68 to prevent the body insert 60 from being removed or disengaged from the inner wall component 24. Once connected to the container body 12, the body insert 60 is preferably permanently fixed in place.

Referring again to FIGS. 2 and 7-9, in one embodiment a gasket 72 is provided to assist in sealing the connection between the body insert 60 and the inner wall component 24. As is described additionally herein, the gasket 72 also assists in sealing an exit to the cavity 28 between the inner and outer wall components 24, 26. The gasket 72 has an outer geometry that generally mirrors the sidewall 38 configuration of the outer wall component 26, including having a recess that matches the recess 36 in the outer wall component 26. The gasket 72 also has an aperture 74 through which the lower generally cylindrical portion 64 is fitted. The gasket 72 is generally positioned against the lower surface 78 of the flange 66 of the body insert 60. Accordingly, as the lower generally cylindrical portion 64 of the body insert 60 is pressed into the opening 31 of the inner wall component 24, and as the shoulder 68 is positioned in the first circumferential ring 54, a radially inward portion of the gasket 72 is squeezed between the lower surface 78 of the flange 66 and the end of the sidewall 30 at the opening 31 of the inner wall component 24 to operate as a seal and prevent liquid from escaping between the body insert 60 and the inner wall component 24. Additionally, an outer portion of the gasket 72 has a wiper seal 76 that engages the inner surface of the sidewall 38 of the outer wall component 26. The outer portion of the gasket 72 generally operates as a seal or barrier at one end of the cavity 28 between the inner wall component 24 and the outer wall component 26.

Figure 9:
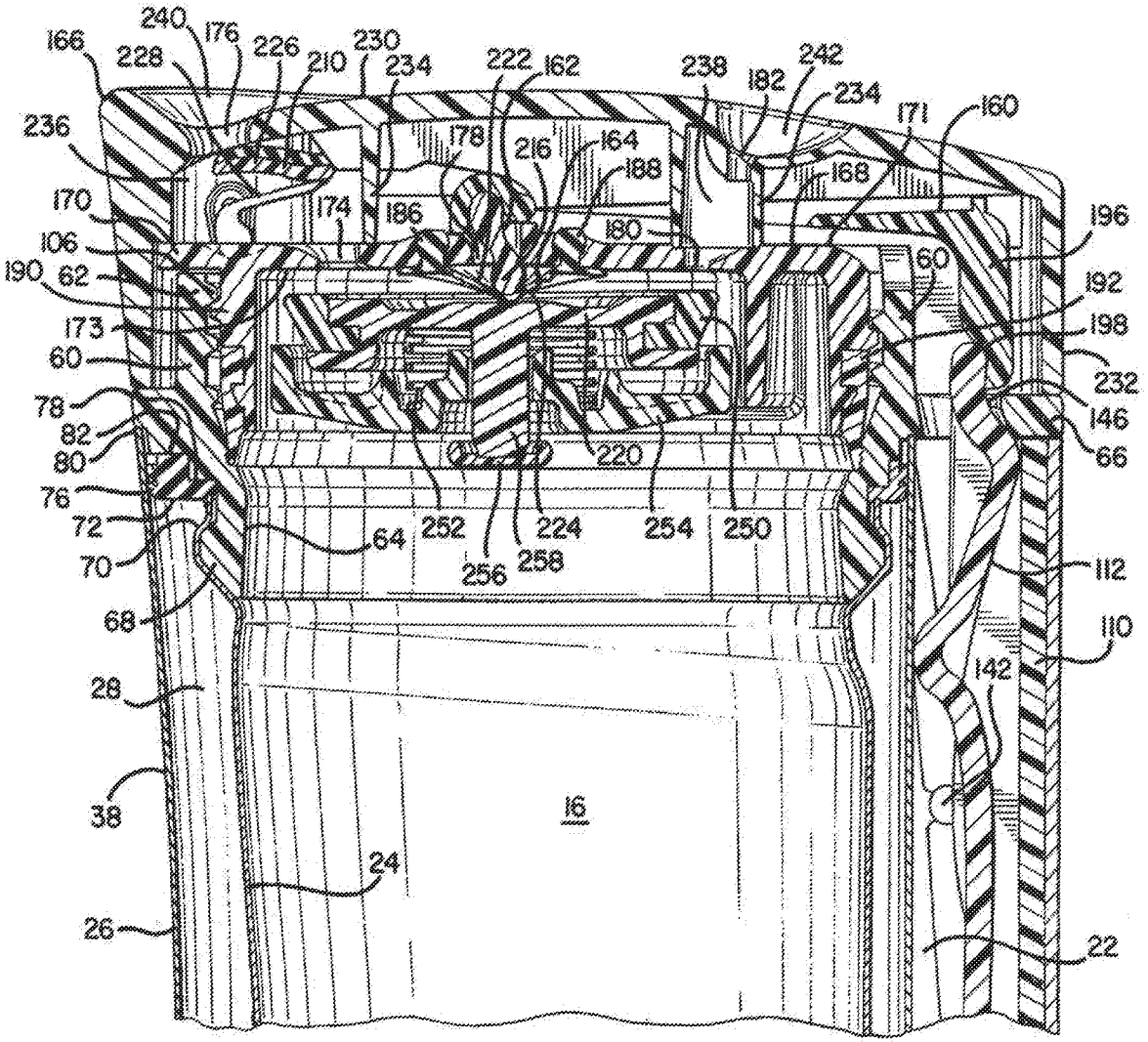
FIG. 9 is an enlarged cross-sectional side view about line 7-7 of the insulated drinking container of FIG. 5, with the sealing mechanism in the actuated position.

As explained above, the flange 66 extends from a perimeter of the body insert 60 between the upper generally cylindrical portion 62 and the lower generally cylindrical portion 64. In one embodiment, the flange 66 has a first surface 78 that engages the gasket 72 between the body insert 60 and the inner wall component 24, and a second surface 80 that engages the lip of the outer wall component 26 adjacent the first opening 42 of the outer wall component 26, and is positioned between the container body 12 and the lid assembly 14 when the lid assembly 14 is fitted on the container body 12. As shown in FIG. 9, the second surface 80 of the flange 66 has a plurality of steps 82. One step is the portion of the flange 66 that engages the lip of the outer wall component 26, and other steps 82 assist in properly seating and retaining the gasket 72, which has a corresponding step that mates with the steps 82 in the flange 66.

The flange 66 has a perimeter that generally mirrors the perimeter of the lid assembly 14 of the container 10.

Accordingly, as shown in FIG. 2, the flange 66 has a portion which extends above the recess 22 in the container body 12. This portion of the flange 66 has an aperture 87 therethrough which allows a portion of the trigger assembly 20 to extend through the flange 66 and to mate with the transfer bar 160 in the lid assembly 14. As shown in FIG. 2, the flange 66 also has a pair of pivot retainers 89 depending from the lower surface 78 of the flange 66 on opposing sides of the aperture 87 in the flange 66. As explained herein, the pivot retainers 89 engage ears 134 (see FIG. 2) extending from the trigger assembly 20 to allow the trigger assembly 20 to pivot thereabout for actuating the seal assembly 18 in the lid assembly 14.

After the body insert 60 is seated in the inner wall component 24 and the inner wall component 24 is fitted into the hollow interior of the outer wall component 26 such that the second surface 80 of the flange 66 engages the lip of the outer wall component 26, the inner wall component 24 can be fixed to the outer wall component 26.

To fixedly join the inner wall component 24 to the outer wall component 26 in a preferred embodiment, a variety of components and/or fasteners are utilized, such as a wall nut 88, a base 90 and a fastener 92. Referring to FIGS. 7 and 8, the wall nut 88 is fixed to the bottom wall 32 of the inner wall component 24 within a depression 94 at the outside of the bottom wall 32. The base 90 is a generally planar circular metal component having a plurality of apertures therein. In one embodiment, the base 90 is welded to a lip at the second opening 44 of the outer wall component 26. Next the fastener 92, such as a screw, is inserted through the middle aperture 100 in the base 90 and is threaded into the wall nut 88. As the fastener 92 is turned, the outer wall component 26 is pulled tighter against the inner wall component 24 until the second surface 80 of the flange 66 engages the lip of the outer wall component 26. After the outer and inner wall components 24, 26 are adequately secured together, insulation is injected into the cavity 28 between the inner wall component 24 and the outer wall component 26. To accomplish this step, in a preferred embodiment the insulation foam is injected into the cavity 28 through one of the apertures, while the other aperture is used to allow air to escape from the cavity 28.

After the cavity 28 is filled with foam insulation the bottom member 102 of the container body 12 is connected to the outer wall component 26. In one embodiment, the bottom member 102 has a cup-like configuration. The bottom member 102 operates to conceal the base 90 and the affixing components that connect the inner and outer wall components 24, 26, as well as concealing the apertures in the base 90. The sidewall 104 of the bottom member 102 is secured, typically via ultrasonic welding, to the outer portion of the sidewall 38 of the outer wall component 26 to complete the container body 12.

Referring again to the body insert 60 as shown in FIGS. 7-11, an upper generally cylindrical portion 62 is provided above the flange 66 and on the opposite side of the flange 66 as the lower generally cylindrical portion 64 identified above. The upper generally cylindrical portion 62 has a first mating member 106, which in a preferred embodiment is an internal thread 106 on the inner surface of the upper generally cylindrical portion 62, that allows the body insert 60 to accept and retain the lid assembly 14 through the use of a corresponding mating member 190, which is preferably a mating external thread, on a portion of the lid assembly 14. Alternatively, the first mating member 106 may be a bayonet-style mating member that is adapted to mate with the lid assembly 14 to secure the lid assembly 14 to the body insert 60, or some other style mating member. In a preferred embodiment, the lid assembly 14 is connected to the body insert 60 in only a single final position, thereby allowing various components of the trigger mechanism 20 to mate with various components of the sealing assembly 18 in the lid assembly 14 as is explained herein. In one embodiment, as shown in FIG. 2, the upper generally cylindrical portion 62 has a notch 108 which operates as a stop to ensure that the lid assembly 14 is not overtightened on the container body 12 and thus is properly seated on the body insert 60 such that the transfer bar 160 will appropriately engage the pusher lever 112 of the trigger assembly 20.

Further, while the body insert 60 is generally made of a plastic material, in one embodiment the body insert 60 is made of a thermoplastic material which changes color as the liquid in the liquid receptacle 16 of the container 10 changes temperature. Accordingly, the user will be alerted as to the approximate temperature category of the liquid contents of the container 10. For example, in one embodiment the body insert 60 is orange at room temperature, but changes to white as its temperature increases. In use the body insert 60 will change to white when the temperature of the liquid contents is approximately greater than 120° F. As the temperature of the liquid contents decreases the orange color of the body insert 60 will intensify until the body insert 60 becomes, as in one embodiment, an orange color. Thus, in such an embodiment when the body insert 60 is an orange color it is an indication to the user that the temperature of the liquid contents is approximately 90° F. or less.

As shown in FIGS. 2, 7, 9 and 10, the trigger assembly 20 generally comprises a trigger member 110 and a pusher lever 112. The trigger assembly 20 generally resides in the recess 22 in the container body 12. In one embodiment additional components, such as the trigger plate 114, the body panel 50 and the body panel plate 118 are also provided therewith.

Referring to FIGS. 2 and 7, the body panel plate 118 is generally an aesthetic fixture mounted to the body panel 50, and similarly the trigger plate 114 is generally an aesthetic fixture mounted to the trigger member 110. In a preferred embodiment the body panel 50 and the trigger member 110 are made of a plastic material, such as ABS, and the body panel plate 118 and the trigger plate 114 are generally made of a textured fabric in a preferred embodiment, however, they may also be made of any acceptable material, including a stainless steel material. As explained above, the body panel 50 with the body panel plate 118 connected thereto is generally fixed in the second portion 48 of the recess 22. More specifically, as shown in FIG. 2, the body panel 50 is connected in the recess 22 of the container body 12 at the top and bottom ends of the body panel 50. To connect the bottom end of the body panel 50 in one embodiment, a lip 53 extends from the bottom of the body panel 50, and the lip 53 is seated between the outer surface of the sidewall 38 of the outer wall component 26 in the second portion 48 of the depression 36, and the inner surface of the sidewall 104 of the bottom member 102. After the lip 53 is properly seated the top end of the body panel 50 can be secured to the container body 12. To accomplish this the top end of the body panel 50 is snapped against a connector 52 extending from the outer surface of the sidewall 38 of the outer wall component 26 in the second portion 48 of the depression 36, and held in place by the connector 52. Because the body panel 50 is connected to the outer wall component 26 of the container 10 and within the depression 36 thereof, the outer surface of the body panel 50 (i.e., the body panel plate 118) generally continues the generally cylindrical outer circumference of the lower portion of the container 10.

After the body panel 50 is seated in place the trigger assembly 20 can be connected to the container 10. In one embodiment, however, a portion of the trigger assembly 20 is preassembled prior to connecting the trigger assembly 20 to the container 10. To accomplish the preassembly of this trigger assembly 20, the trigger plate 114 is first fixed to the trigger member 110. In a preferred embodiment the trigger member 110 is made of a plastic material, such as ABS, and the trigger plate 114 is made of stainless steel.

As shown in FIGS. 1 and 2, the trigger member 110 has a geometry that generally matches the geometry of the recess 22 of the container body 12. Accordingly, in one embodiment the trigger member 110 is longitudinal in shape. In such a configuration the trigger member 110 has a first end 120, a second end 122, a first sidewall, 124, a second sidewall 126, an outer surface 128 (generally comprising the outer surface of the trigger plate 114, if one is affixed thereto), an inner surface 130, and a receiver 132 for connecting with the pusher lever 112. The trigger member 110 also a pair of ears 134 extending from the trigger member 110 adjacent the first end 120 thereof, and a stop 136 adjacent the second end 122 of the trigger member 110. The ears 134 on the trigger member 110 engage the respective pivot retainers 89 depending from the lower surface of the flange 66 to connect the trigger assembly 14 to the container 10. Most preferably, the ears 134 on the trigger member 110 have a cylindrically shaped portion which is inserted into a mating aperture in each respective pivot retainer 89 to fix the trigger assembly 20 to the body insert 60, but also to allow the trigger member 110 to rotate about a pivot axis defined by a centerline through the pivot retainers 89. Further, the trigger member 110 has a protrusion 135 extending from the outer surface 128 at the second end 122 of the trigger member 110 that operates as an indicator to indicate to the user where to push the trigger member 110 to actuate the sealing mechanism 18 on the container 10 for allowing liquid to be dispelled from the container 10.

In one embodiment, the receiver 132 of the trigger member 110 comprises a mating portion of the trigger member 110 into which a portion of the pusher lever 112 is inserted to mate the pusher lever 112 with the trigger member 110. As shown in FIG. 2, in a preferred embodiment the receiver 132 comprises an opening adjacent the inner surface 130 and extending through a portion of both the first and second sidewalls 124, 126 of the trigger member 110. As is explained herein, pins 142 on the pusher lever 112 are inserted into the receivers 132 to retain the pusher lever 112 to the trigger member 110, but also to allow the pusher lever 112 to rotate with respect to the trigger member 110. Generally, the pusher lever 112 is connected to and pivots about the receiver 132 of the trigger member 110 at a position located generally a distance from the first end 120 of the trigger member 110. In one embodiment the pusher lever 112 pivots about the trigger member 110 at a location approximately ¼ of the length down from the first end 120 of the trigger 110.

As best shown in FIGS. 2 and 7, in one embodiment the pusher lever 112 comprises a body portion 140, a plurality of pins 142, a spring lever 144, and an engaging member 146. In this embodiment the spring lever 144 extends from a lower side of the body portion 140 and is generally elongated in shape with a central portion 148 and an end 150 positioned distal both the body portion 140 and the pivot pins 142 extending from the body portion 140. Accordingly, in this embodiment the spring lever 144 operates as a leaf spring. The engaging member 146 of the pusher lever 112 generally extends from an opposing upper side of the body portion 140. The engaging member 146 has a detent area 152 that assists in engaging and retaining the transfer bar 160 for manipulating the sealing assembly 18 following actuation of the trigger member 110.

As explained above, the pusher lever 112 is connected to the trigger member 110 by inserting the pins 142 of the pusher lever 112 into the receiver 132 on the trigger member 110. In this embodiment, however, the pusher lever 112 can still pivot about the axis of the pins 142 within the receiver 132 of the trigger member 110. After the pusher lever 112 is connected to the trigger member 110 the trigger assembly 20 can be connected to the container body 12. To connect the trigger assembly 20 to the container body 12 the stop 136 at the second end 122 of the trigger member 110 is fitted in a recessed slot 154 on the top of the body panel 50; the engaging member 146 of the pusher lever 112 is fitted through the aperture 87 in the flange 66 of the body insert 60; and the ears 134 on the trigger member 110 are connected in a pivotal relationship within the pivot retainers 89 extending from a lower surface of the flange 66 of the body insert 60. Accordingly, referring to FIG. 7, when the trigger assembly 20 is inserted in position on the container body 12, the end 150 of the spring lever 144 of the pusher lever 112 engages the sidewall 38 in the recess 36 of the outer wall component 26 of the container body 12, and the central portion 148 of the spring lever 144 engages the inner surface 130 of the trigger member 110, while the pivot pins 142 pivot in the receiver 132 of the trigger member 110.

Figure 11:
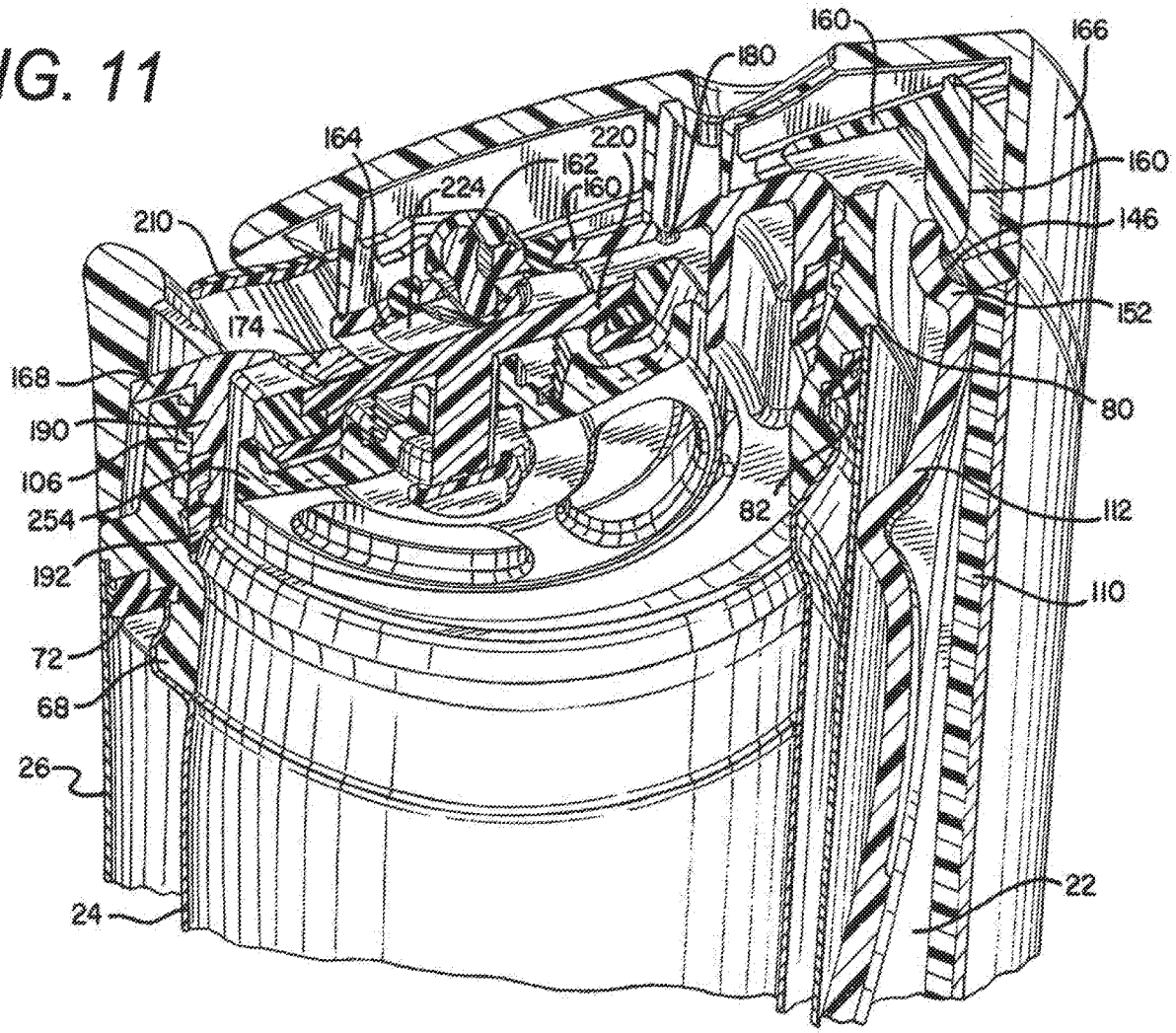
FIG. 11 is a cross-sectional perspective view of the sealing mechanism for an insulated drinking container in the actuated position.

FIG. 7 illustrates one embodiment of the container 10 in the normal position wherein the sealing mechanism 18 is closed. Conversely, FIGS. 9 and 11 illustrate one embodiment of the container 10 in the actuated position whereby the sealing mechanism 18 is open. To actuate the trigger assembly 20, the trigger 110 is pushed radially inward (generally at the protrusion 135 extending from the outer surface 128 at the second end 122 of the trigger member 110) toward the recess 22. As the second end 122 of the trigger 110 pivots radially inward about its ears 124 in the pivot retainers 89 and toward the sidewall 38 of the outer wall component 26, the inner surface 130 of the trigger member 110 pushes on the central portion 148 of the spring lever 144. Because the end 150 of the spring lever 144 is positioned against the sidewall 38 of the outer wall component 26, when the central portion 148 of the spring lever 144 is pushed inwardly, the pusher lever 112 pivots about the axis of the pivot pins 142 thereby moving the engaging member 146 at the top of the pusher lever 112 radially outward in the aperture 87 of the flange 66 of the body insert 60. Thus, as the user actuates the trigger 110 by pushing inward on the protrusion 135, the engaging member 146 of the pusher lever 112 pivots away from the central axis of the container body 12. By connecting the pivots pins 142 to the trigger 110 down from the first end 120 of the trigger member 110, increased travel of the engaging member 146 portion of the pusher lever 112 radially outwardly is attained. As shown in the Figures, the outer surface of the trigger 110 is generally a continuum of the outer wall 38 of the cup body 12. Further, the outer surface of the trigger 110 is generally coplanar with the outer wall 38 of the cup body 12.

In an alternate embodiment, the first end 120 of the trigger 110 may be pushed radially inward toward the longitudinal recess 22 to pivot the second end 122 of the trigger 110 outward from the container body 12 and to thereby provide a hook for sliding a strap, belt or some other member between the container body 12 and trigger 110 for retaining the container 10 thereto.

Referring now to FIGS. 3 and 7-12, a plurality of components provided in the lid assembly 14 are utilized to interact between the trigger assembly 20 and the sealing assembly 18. Such components are actuated by components of the trigger mechanism 20 and, in one embodiment, may include a transfer bar 160, a pivot link 162, and a pivot seal 164. The transfer bar 160 and the pivot link 162 are generally provided between the upper lid 166 and the lower lid 168, and a majority of the pivot seal 164 is generally provided below the lower lid 168. As is explained in detail herein, after the appropriate components are assembled between the upper and lower lids, the lower lid 168 is permanently fixed, such as by ultrasonic welding, to the upper lid 166.

Figure 3:
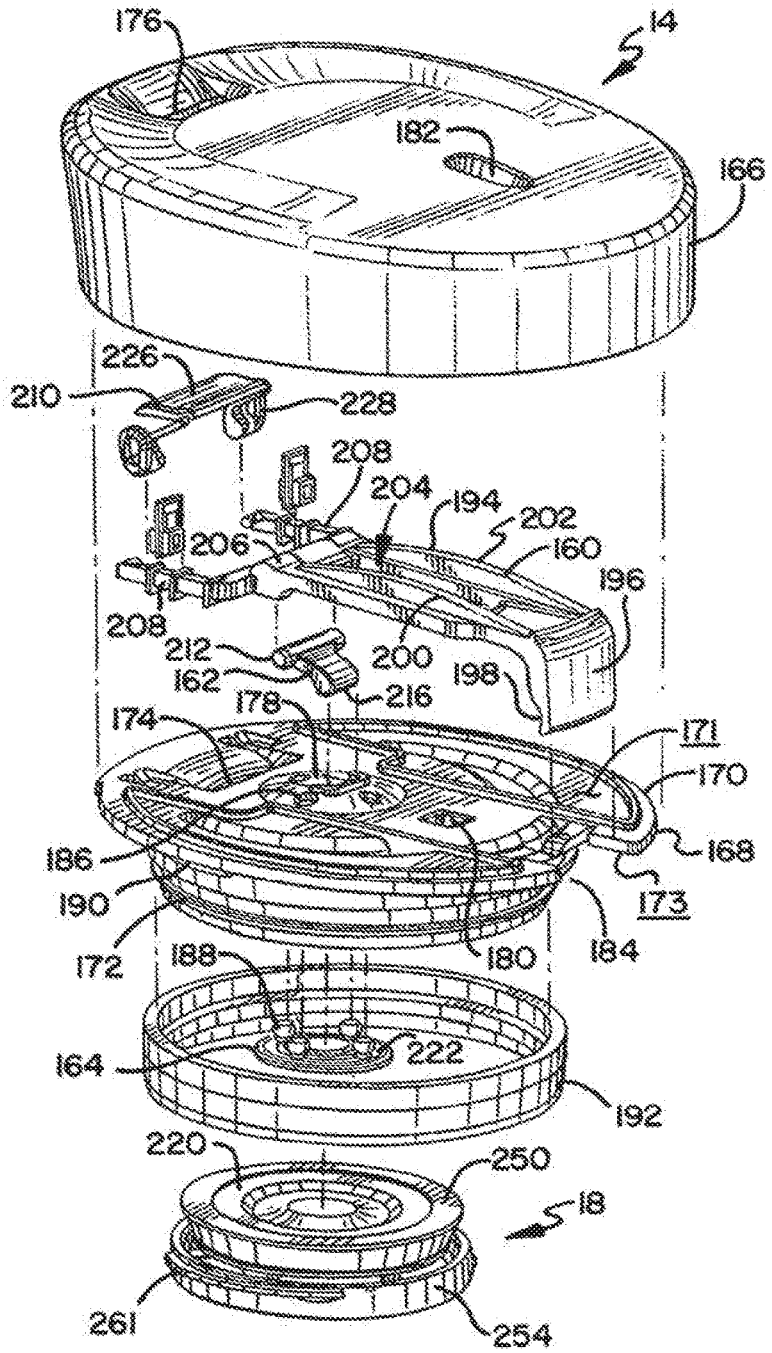
FIG. 3 is an exploded perspective view of one embodiment of a lid assembly for an insulated drinking container.

In a preferred embodiment as shown in FIGS. 3 and 9, the lower lid 168 comprises a base member 170 having an upper surface 171 and a lower surface 173, and a generally cylindrical extension 172 extending from the lower surface 173. The base member 170 has a plurality of apertures therein. For example, a first aperture 174 is provided to allow liquid to pass out of the liquid receptacle 16 and through the drink orifice 176 in the upper lid 166. A second aperture 178 is provided to allow the pivot link 162 to rotate against the pivot seal 164 to actuate the plunger 220. A third aperture 180 is provided as a vent opening to mate with the vent hole 182 in the upper lid 166 to allow built-up pressure to escape out of the drink receptacle 16. A fourth aperture or recess 184 is provided in the base member 170 to allow a portion of the transfer bar 160 to extend downward through the base member 170 to engage the trigger mechanism 20. Finally, a series of apertures 186 are provided to retain extensions 188 of the pivot seal 164 to connect the pivot seal 164 in place. In a preferred embodiment the surface of the base member 170 is polished around the first and third apertures 174, 180 to assist in allowing excess liquid that is not expelled out through the respective openings in the upper lid 166 to drain more easily back into the liquid cavity 16 of the container 10. Similarly, the top surface of the upper lid 166 adjacent the drinking orifice and the vent hole are also preferably polished to allow excess liquid to drain more easily back into the drink receptacle 16.

The generally cylindrical extension 172 protruding downwardly from the lower surface 173 of the base member 170 is utilized to mate the lid assembly 14 to the container body 12. A mating member 190, which in one embodiment is an external thread 190 on the outer surface of the cylindrical extension 172, is adapted to mate with the first mating member 106 of the upper generally cylindrical portion 62 of the body insert 60 to join the lid assembly 14 to the container body 60. The cylindrical extension 172 has a first end that is adjacent and joined to the base member 170, and a second end that extends away from and distal the base member 170. Preferably, the mating member 190 is provided toward the first end of the cylindrical extension 172. As shown in FIGS. 9-12, a lid seal 192 is joined to the second end of the cylindrical extension 172 about the outer circumference thereof to assist in sealing the lid assembly 14 to the container body 12. In one embodiment the lower lid 168 is made of a plastic material, such as an ABS material, and the lid seal 192 is made of silicon that is overmolded on the outer circumference of the cylindrical extension 172. Referring to FIG. 9, when the lid assembly 14 is fitted on the container body 12, the lid seal 192 engages the interior surface of the body insert 60 to prevent liquid from escaping between the body insert 60 and the lower lid 168.

Figure 12:
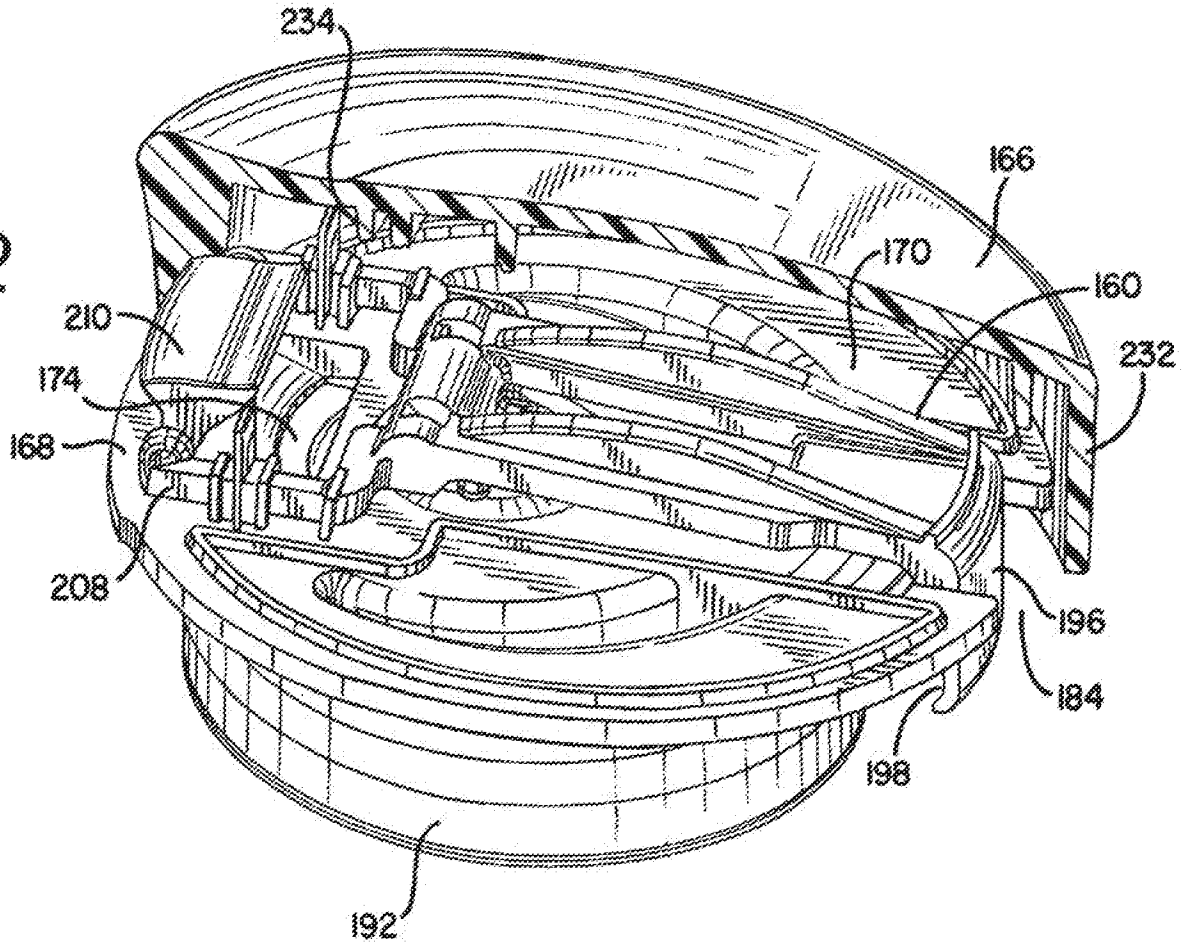
FIG. 12 is a top perspective view of a sealing mechanism for an insulated drinking container with the lid cover partially broken away.
Figure 13:
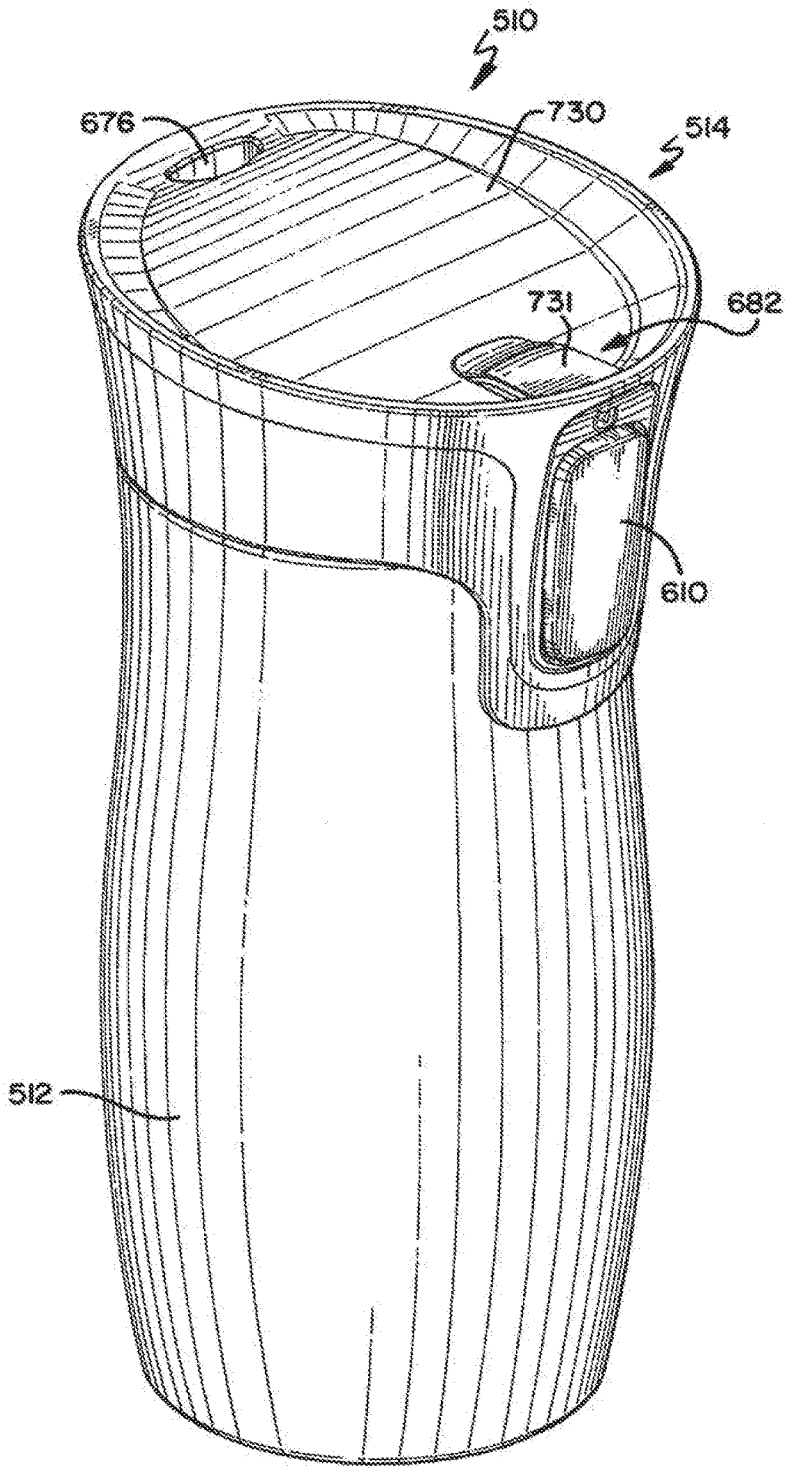
FIG. 13 is a front perspective view of another embodiment of a drinking container having a lid with a trigger actuated drinking orifice.

Referring again to the components in the lid assembly 14, as best shown in FIGS. 3 and 12, in one embodiment the transfer bar 160 is generally L-shaped with a main body portion 194 generally resting on the upper surface 171 of the base member 170 of the lower lid 168, and a transverse component 196 extending downward through a recess or aperture 184 in the base member 170 of the lower lid 168. The transverse component 196 has a mating surface 198 which is utilized to engage a mating surface 152 on the engaging member 146 of the pusher lever 112. The main body portion 194 of the transfer bar 160 generally comprises first and second opposing walls 200, 202 with an opening 204 therebetween. A transverse portion 206 joins the first and second opposing walls 200, 202. The transverse portion 206 is also connected to the pivot link 162 to pivot or rotate the pivot link 162 that extends through the second aperture 178 in the base member 170 of the lower lid 168 and between the opposing walls 200, 202 and against the pivot seal 164 to actuate a portion of the sealing assembly 18. The transfer bar 160 also has a pair of arms 208 which are connected to a shutter 210 to actuate the shutter 210 as described in more detail herein. Accordingly, the shutter 210 is mechanically connected to the trigger 110.

As best shown in FIG. 3, the pivot link 162 has a shaft 212 portion at a first end of the pivot link 162 that connects in a receiver in the transverse portion 206 of the transfer bar 160. The second end 216 of the pivot link extends through the second aperture 178 in the lower lid 168 and contacts the upper surface 222 of the pivot seal 164. Accordingly, the pivot link 162 operates as a cam as the transfer bar 160 moves from its first or normal position (see FIGS. 7 and 10) to its second or actuated position (see FIGS. 9 and 11) to press on the pivot seal 164 and deform the pivot seal 164 downwardly against the plunger 220 of the seal assembly 18.

As shown in FIGS. 3 and 9-11, in one embodiment the pivot seal 164 has an upper first surface 222 and a lower second surface 224. A perimeter of the upper surface 222 of the pivot seal 164 is connected, preferably in a fixed manner, to the lower surface 173 of the base member 170 of the lower lid 168 (see FIG. 11). A central portion of the pivot seal 164 is resilient and can be deformed by the pivot link 162. For example, when the trigger mechanism 20 is in the normal position the pivot link 162 merely rests on the upper surface 222 of the pivot seal 164, but generally does not deform the pivot seal 164 (see FIGS. 7 and 10). When the trigger mechanism 20 is actuated to open the seal assembly 18 so that liquid can be dispelled from the container 10, the pivot link 162 pushes downwardly on the upper surface 222 of the pivot seal 164 to deform the pivot seal 164 and press the lower surface 224 of the pivot seal 164 against the plunger 220 of the seal assembly 18 (see FIGS. 9 and 11).

In a preferred embodiment the shutter 210 operates as a closing member for the drinking orifice 176 in the upper lid 166. Because the shutter 210 is connected to the arms 208 of the transfer bar 160, as the trigger assembly 20 is actuated the shutter 210 is opened and closed. In one embodiment the shutter 210 has a panel 226 connected to a pair of arms 228. The shutter arms 228 are connected to the arms 208 of the transfer bar 160. In the normal or closed position the shutter 210 closes the drinking orifice 176 (see FIG. 10), but as the transfer bar 160 is moved by the trigger mechanism 20 the shutter 210 rotates backwards to open the drinking orifice 176 in the upper lid 166 (see FIGS. 9 and 11). A gasket or seal is preferably provided at the connection surfaces between the drinking orifice 176 and the panel 226 of the shutter 210. In one embodiment a silicon seal is overmolded on the upper surface of the panel 226 to seal the drinking orifice 176 when the shutter 210 is in the closed position, and in another embodiment a silicon seal is overmolded on the underside of the perimeter of the drinking orifice 176 to perform the same function.

Generally, the transfer bar 160, with pivot link 162 and shutter 210 connected thereto is placed in the appropriate location on the upper surface 171 of the base member 170 of the lower lid 168 prior to joining the upper lid 166 to the lower lid.

Figure 5:
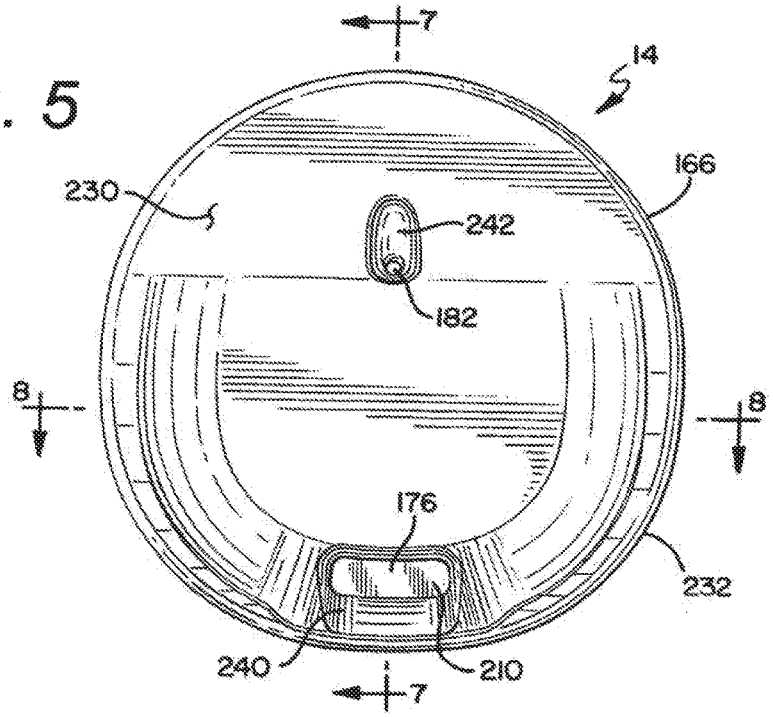
FIG. 5 is a top plan view of the lid assembly of FIG. 3.

Referring to FIGS. 3, 5 and 9, the upper lid 168 generally comprises a top drinking surface 230, a sidewall 232 extending down from the drinking surface 230, and a plurality of internal ribs 234 extending down from the underside of the top drinking surface 230 to define a plurality of chambers, including a drinking chamber 236 and a vent chamber 238. The drink orifice 176 extends through the top drinking surface 230 and provides access to the drinking chamber 236, whereas the vent hole 182 extends through the top drinking surface 230 and provides access to the vent chamber 238. A slight depression or well 240 is provided in the top drinking surface 230 adjacent the drink orifice 176 to assist the flow of liquid to the user's mouth and to drain any remnant liquid back into the drinking chamber 236 for sealing by the shutter 210. Similarly, a slight depression or well 242 is provided in the top drinking surface 230 adjacent the vent hole 182.

The upper lid 166 is connected to the lower lid 168, typically via ultrasonic welding, in strategic locations to properly direct the flow of liquid out of the liquid receptacle 16 and through the drinking hole 176 to the user, as well as directing gaseous pressure out of the liquid receptacle 16 and through the vent hole 182. For example, in one embodiment the upper surface 171 of the base member 170 of the lower lid 168 is ultrasonically welded to the upper lid 166 at a shoulder in the sidewall and at various ribs 234 to ensure that liquid that flows out of the liquid receptacle 16, when the sealing assembly 18 is actuated and the plunger 220 pushed down, through the first aperture 174 and into the drinking chamber 236 for dispelling through the drink orifice 176 in the upper lid 166, without escaping elsewhere. Similarly, in one embodiment the upper surface 171 of the base member 170 of the lower lid 168 is ultrasonically welded to the upper lid 166 at the ribs 234, which defines the sidewalls of the vent chamber 238, to ensure that gas and/or liquid that is to vent out the vent hole 182 in the upper lid 166, for example when the sealing assembly 18 is actuated and the plunger is pushed down, flows through the third aperture 180 in the lower lid 168 and into the vent chamber 238 for dispelling through the vent hole 182 in the upper lid 166. Further, as shown in FIG. 9, the third aperture 180 in the lower lid 168 has a first cross-sectional area and first volume, and vent chamber 238 has a second cross-sectional area and a second volume. The cross-sectional area and volume of the vent chamber 238 being larger than that of the third aperture 180. Thus, the size of the vent chamber 238 is substantially larger than the size of the opening to the third aperture 180 such that as the sealing mechanism 18 is actuated and gas and/or liquid is released through the third aperture 180 in the lower lid 168, the pressure is dissipated in the vent chamber 238 and is not transferred out through the vent hole 182, which has generally the same area as the third aperture 180. This is to prevent a chimney effect through the vent holes.

Figure 4:
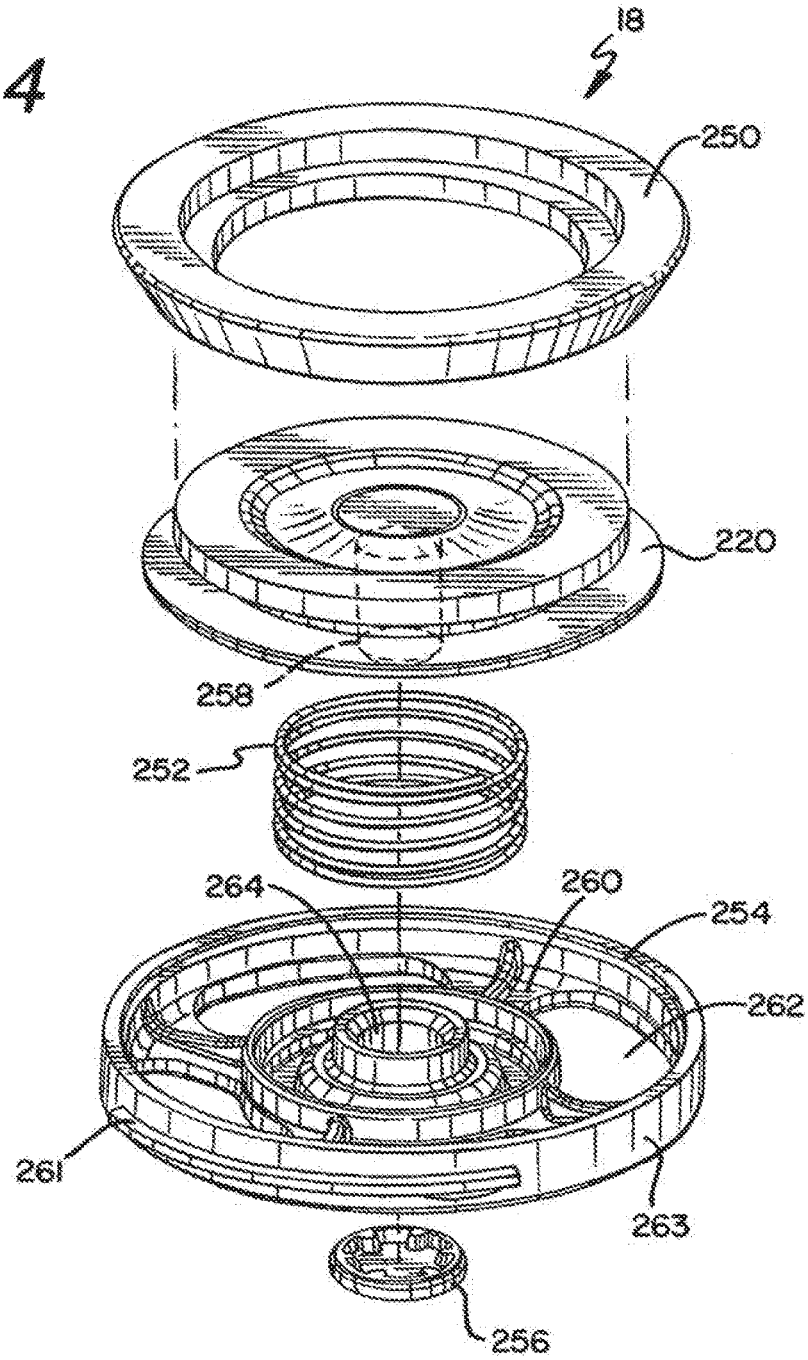
FIG. 4 is an exploded perspective view of one embodiment of a plunger assembly for an insulated drinking container.

The sealing assembly 18 is shown in FIGS. 3, 4 and 6-12. The sealing assembly 18 is connected to the lid assembly 14, and in one embodiment the sealing assembly 18 is removably connected to the lower lid 168. As best shown in FIG. 4, at least a portion of the sealing assembly 18 generally comprises a plunger 220, a plunger gasket 250, a spring 252, a plunger retainer 254 and an end cap 256. In different embodiments the shutter 210 is also part of the sealing assembly 18. In one embodiment the plunger 220 is made of a plastic material, and the plunger gasket 250 is a silicon component that operates as a seal and is connected to the plunger 220. The plunger gasket 250 is fixed to the plunger 210 to seal the plunger 220 against the lower surface 173 of the base member 170 of the lower lid 168 in the normal position of the trigger assembly 20 to simultaneously prevent liquid and/or gas from exiting the liquid receptacle 26 through any of the apertures 174, 180 in the lower lid 168. Accordingly, the seal operates as a valve for the container 10.

As best shown in FIG. 4, the plunger 220 has an integral post 258 extending from a bottom of the plunger 220. The post 258 of the plunger 220 is utilized to connect the plunger 220 to the plunger retainer 254 with the spring 252 therebetween. The plunger retainer 254 is a plastic component that has a plurality of spokes 260 and apertures 262, and a main bore 264 through which the plunger post 258 is inserted. Specifically, the spring 252 is placed around the plunger post 258, and the plunger post 258 is pushed downward into the main bore 264 of the plunger retainer 254. An end of the plunger post 258 is pushed beyond the lower surface of the plunger retainer 254 and is retained in place with the end cap 256 to secure the plunger 220 to the plunger retainer 254 with the spring 252 therebetween, thereby creating a plunger assembly. The spring 252, which is a preferably a stainless-steel compression spring in one embodiment, is positioned between the plunger 220 and the plunger retainer 254 to exert a separation force to push the plunger 220 away from the plunger retainer 254. Thus, through the geometry of the components of the seal assembly 18 described above, the sealing assembly 18 is standalone sub-assembly.

In on embodiment the sealing assembly 18 is removably connected to the lid assembly 14 to allow the sealing assembly 18 to be removed for cleaning of the container 10. Further, in a preferred embodiment the plunger retainer 254 has external threads 261 on an outer surface of the sidewall 263 of the plunger retainer 254. Similarly, mating internal threads 265 are provided on the inner surface of the cylindrical extension 172 of the lower lid 168. The combination of these mating members 261, 265 allow the sealing assembly 18 to be screwed to the mating threads on the underside of the lower lid 168 to secure the sealing assembly 18 in place (see FIG. 6), and subsequently unscrewed to be removed as a complete sub-assembly for cleaning.

Figure 10:
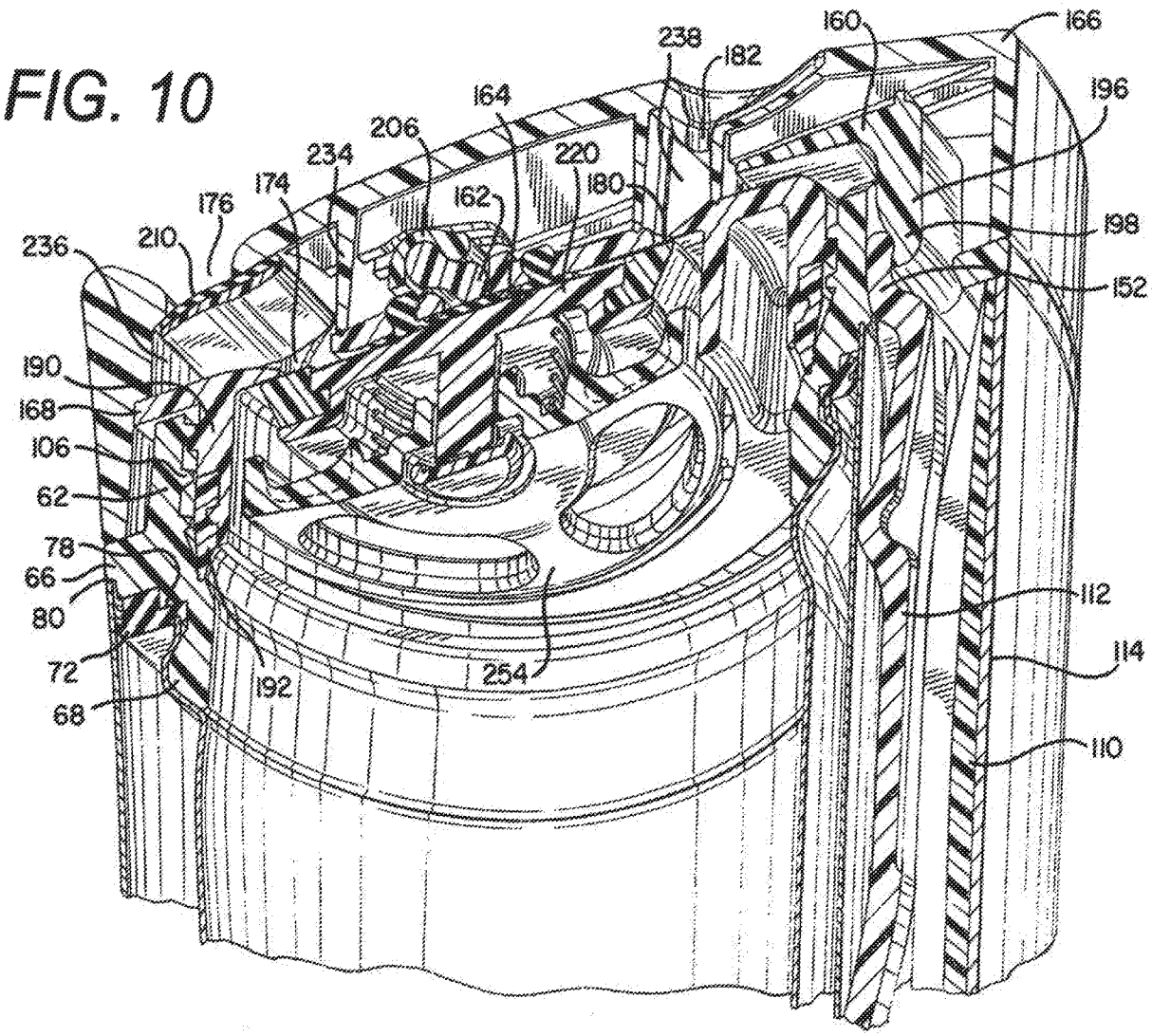
FIG. 10 is a cross-sectional perspective view of the sealing mechanism for an insulated drinking container in the normal position.

In the closed or normal position, as shown in FIGS. 7, 8 and 10, the plunger gasket 250 simultaneously closes both the first aperture 174 leading to the drinking chamber 236 and the drinking orifice 176, as well as the third aperture 180 leading to the vent chamber 238 and the vent hole 182. Similarly, as shown in FIGS. 9 and 11, in the actuated or open position the plunger gasket 250 simultaneously opens fluid flow through the first aperture 174 leading to the drinking chamber 236 and the drinking orifice 176, as well as the third aperture 180 leading to the vent chamber 238 and the vent hole 182.

Thus, when the user depresses or actuates the trigger 110 on the side of the container body 12, the trigger 110 actuates the pusher lever 112 to move its engaging member 146. The detent area 152 of the engaging member 146 is engaged with a mating surface 198 of the transverse component 196 of the transfer bar 160 in the lid assembly 14 of the container 10. As the pusher lever 112 moves radially outward the entire transfer bar 160 is moved horizontally away from the drinking aperture 176 of the container 10. By moving the transfer bar 160 horizontally away from the drinking aperture 176, the pivot link 162 pivotally connected to the transverse portion 206 of the transfer bar 160 pivots about the axis of its shaft portion 212 at its first end to allow its second end 216 to pivot or rotate downwardly through the second aperture 178 in the lower lid 168 and against the upper surface 218 of the pivot seal 164. The central portion of the pivot seal 164 is deformed downwardly by the force of the pivot link 162 to push the plunger 220 downwardly toward the plunger retainer 254.

Accordingly, as the pivot link 162 rotates downwardly toward the sealing assembly 18 through lateral movement of the transfer bar 160, the pivot link 162 and the pivot seal 164 are pushed downwardly on the plunger 220. The downward force of the pivot link 162 and pivot seal 164 on the plunger 220 causes the plunger 220 to move downward, overcoming the spring force of the spring 252 and breaking the seal between the plunger gasket 250 and the lower surface 173 of the base member 170 of the lower lid 168. Thus, referring to FIGS. 9 and 11, liquid can flow from the liquid receptacle 16 of the container body 12, through the apertures 262 in the plunger retainer 254 and/or around the sidewall of the plunger retainer 254, between the gap between the inner wall of the cylindrical extension of the lower lid 168 and the plunger 220, and up through the fluid aperture 174 in the lower lid 168. Vapor pressure can take a similar path up through the vent holes 180, 182 and vent chamber 238.

As shown in FIGS. 9 and 11, the horizontal motion of the transfer bar 160 also changes the angular orientation of the shutter 210 positioned in the drinking chamber 236 of the lid assembly 14 and at the exit of the drinking aperture 176 in the top of the lid upper 166 of the lid assembly 14. The shutter 210 is pivotally connected to the arms 208 of the transfer bar 160 such that as the transfer bar 160 moves horizontally the shutter 210 rotates about its pivot connection to the open the drinking aperture 176.

Figure 6:
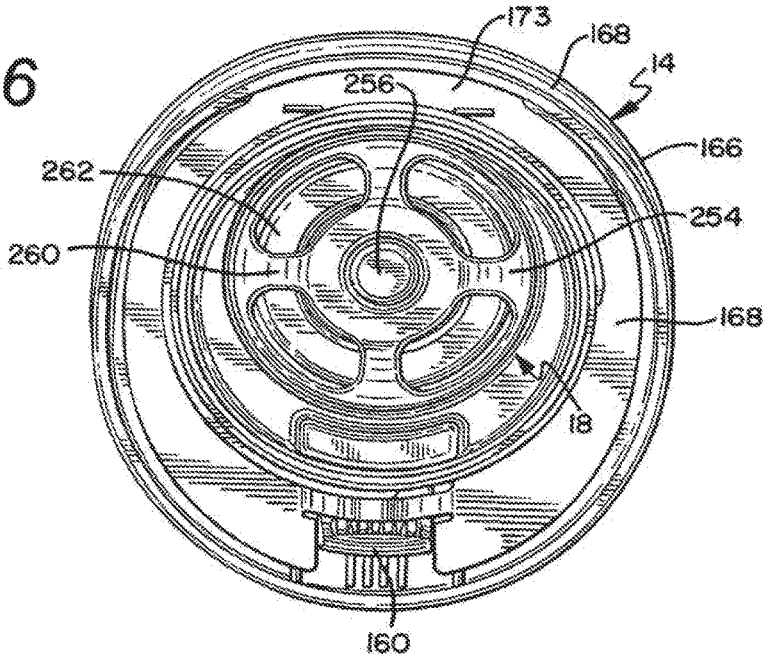
FIG. 6 is a bottom plan view of the lid assembly of FIG. 3.

In sum, when the user depresses the trigger 110 (i.e., actuates the container 10) the pusher lever 112 engages the transfer bar 160 to move the transfer bar 160 horizontally away from the drinking aperture 176, thereby providing pivotal movement to both the pivot link 162 and the shutter 210. The pivotal movement of the pivot link 162 causes the pivot link 162 to push the pivot seal 164 downwardly to engage the plunger 220 and move the plunger 220 downward to break the seal between the plunger gasket 250 and the lower surface 173 of the lid lower 168. The shutter 210 is simultaneously rotated to open the drinking aperture 176. Thus, the liquid can then pass through the fluid aperture 174 in the lid base 168 and out the drinking aperture 176. As shown in FIG. 9, the fluid aperture 174 is offset from the drinking aperture 176. Further, FIGS. 6 and 7 shows that the vertical axis of the entire plunger assembly 18 is offset from the vertical axis of the liquid receptacle 16 of the container body 12.

When the user is done drinking, the user releases the trigger 110 and the sealing assembly 14, including the shutter 210, automatically closes and moves to the normal position. Specifically, the spring force of the spring 252 is no longer overcome and the spring 252 forces the plunger 220 upwards against the bottom 173 of the lid base 168 to close the fluid aperture 174 and the vent aperture 180. As this occurs, the pivot link 162 is rotated upward by the force of the spring 252 forcing the plunger 220 upward, thereby moving the transfer bar 110 to close the shutter 210 back to its normal, closed, non-actuated position. It is further understood that due to the vertical position of the pivot link 162 when the trigger 110 is depressed, the spring force of the spring 252 is substantially transferred into the lid upper 166, thereby making the trigger 110 generally easier to hold in the actuated position when the user drinks liquid flowing out of the container 10.

Another embodiment of a drinking container 510 is shown in FIGS. 13-18. In this embodiment, the drinking container 510 is generally comprised of a container body 512 having a cavity 516 for holding liquid, and a removable lid assembly 514 that can be secured to the container body 512. As explained in detail herein, the lid assembly 514 generally covers an opening to the liquid receptacle 516 in the drinking container 10. In one version of this embodiment a seal assembly 518 and a trigger assembly 520 are combined in the lid assembly 514. The trigger assembly 520 is utilized to operably actuate the seals of the seal assembly 518 to provide for opening and closing one or more openings for allowing liquid to be dispelled from the drinking opening 676 through the liquid receptacle 516 of the drinking container 510, and also for allowing the internal pressure within the liquid receptacle 516 of the container body 512 to be released through the vent hole 682 in the upper lid 665.

The container body 512 of the drinking container 510 may be an insulated container body 512 formed of a dual-walled construction as explained above, it may be an insulated container body formed of a different construction than described above, such as a single-walled construction, or it may be a non-insulated construction container body 512. Additionally, the container body 512 generally has an opening 531 at the end of the sidewall 530 opposing the bottom wall of the container body 512 to provide access into the liquid receptacle 516. The container body 512 generally has a longitudinal axis extending through the center of the container body 512 from the first end adjacent the opening to the second end adjacent the bottom wall of the container body 512.

Referring again to FIGS. 15-18, in one embodiment an upper generally cylindrical portion of the container body 512 has a first mating member 606, which in a preferred embodiment is an internal thread 606 on the inner surface of the container body 512 generally adjacent the opening 531 to the liquid receptacle 516 of the container body 512. The first mating member 606 allows the container body 512 to accept and retain the lid assembly 514 through the use of a corresponding second mating member 690, which is preferably a mating external thread, on a portion of the lid assembly 514. Alternatively, the first mating member 606 may be a bayonet-style mating member that is adapted to mate with the lid assembly 514 to secure the lid assembly 514 to the container body 512, or any other style mating member that will assist in retaining the lid assembly 514 to the container body 512.

The lid assembly 514 generally comprises an upper lid member 665 that is connected to a lower lid member 668. Several gaskets or seals, such as upper lid gasket 667 and lower lid gasket 692 are also a part of the lid assembly 514. Further, in a preferred embodiment, the seal assembly 518, trigger assembly 520, and other components utilized to actuate the seal assembly 518 between the normally closed and actuated positions are provided in the lid assembly 514.

In a preferred embodiment the lower lid member 668 is permanently fixed, such as by ultrasonic welding, to the upper lid member 665 following the assembly of the appropriate components within the lid assembly 514, including components of the seal assembly 518 and trigger mechanism 520, as well as the other additional components utilized to actuate the seals of the seal assembly 518. Some of those additional components include a shutter 710, a first linkage member 800, a second linkage member 802 and a spring 804.

Referring to the embodiment shown in FIGS. 15-18, the lower lid member 668 comprises a generally cylindrical sidewall portion 672, a substantially planar transverse flange member 670 that extends generally radially outwardly from a first or top end of the generally cylindrical sidewall portion 672, and a central bridge member 675 spanning across the generally cylindrical sidewall portion 672. Additionally, several supports, such as a pair of opposing upstanding gusset-type walls 677, a first support member 679 and a second support member 681 extend upwardly from the central bridge member 675. Various apertures are also provided in the lower lid member 668 interior of the perimeter of the sidewall portion 672 to allow the liquid/gas/vapor to pass out of the liquid receptacle 516 and through either the drink orifice 676 in the upper lid 665 or through the vent aperture 682 in the upper lid 665.

The lower lid member 668 of the lid assembly 514 also has a second mating member 690, which in one embodiment is an external thread 690, on the outer surface of the cylindrical sidewall portion 672 below the flange member 670. As briefly explained above, the second mating member 690 is adapted to mate with the first mating member 606 on the inner surface of the container body 512 adjacent the opening 531 to the liquid receptacle 516 of the container body 512 to removably join the lid assembly 514 with the container body 512.

As shown in FIGS. 15-18, the central bridge member 675 generally extends across the opening in the generally cylindrical sidewall member 672. The central bridge member 675 provides additional structural support for the lower lid member 668, as well as providing a base for supporting other members of the lower lid member 668. For example, the upstanding gusset-type walls 677, the first support member 679 and the second support member 681 extend upwardly from the central bridge member 675.

The upstanding gusset-type walls 677 are provided to assist in supporting, preferably pivotally, various components within the lid assembly 514. In a preferred embodiment, the upstanding gusset-type walls have a first set of apertures 683*a* for pivotally supporting the second linkage member 802, and a second set of apertures 683*b* for pivotally supporting the shutter 710. The upstanding gusset-type walls also have an aperture 683*c* for supporting one end of the spring member 804 for the shutter 710.

As explained in more detail herein, the first support member 679 and second support member 681 of the lower lid member 668 are generally utilized to mate with support members of the upper lid member 665 to provide overall rigidity to the lid assembly 514, as well as to retain a portion of the trigger 610 in the appropriate location in the lid assembly.

Referring again to FIGS. 15-18, the lower lid gasket 692 is provided against the lower surface of the substantially planar transverse flange member 670 that extends generally radially outwardly from the generally cylindrical sidewall portion 672. In one embodiment the lower lid gasket 692 is a form of an O-ring and thus the lower lid gasket 692 assists in sealing the lid assembly 514 to the container body 512. In one embodiment the lower lid 668 (preferably as well as the upper lid 665) is made of a plastic material, such as an ABS material, and the lower lid gasket 692 is made of silicon. Referring to FIGS. 15-18, when the lid assembly 514 is fitted on the container body 512, the lower lid gasket 692 engages the top of the sidewall 530 of the container body 512 to prevent liquid from escaping between the container body 512 and the lower lid 668.

As explained above, in a preferred embodiment, the lower lid 668 is fixedly connected to the upper lid 665 after the sealing assembly 518, trigger assembly 520 and related components have been fixed in place within the lid assembly 514. Referring to FIGS. 15-18, the upper lid 665 generally comprises a top drinking surface 730, a sidewall 732 extending down from the drinking surface 730, and a plurality of internal ribs 734 extending down from the underside of the top drinking surface 730 which are utilized to provide structural stability and a connection point between the upper and lower lids 665, 668. The upper lid 665 also has a drink orifice 676 that extends through the top drinking surface 730 and operably provides access to the liquid receptacle 516 of the container body 512, as well as a vent aperture 682 that extends through the top drinking surface 730 and operably provides access to a vent chamber 738 of the drinking container 510.

The vent chamber 738 is an enclosed chamber that is located beneath the vent aperture 682 and between the vent seal 683 and the vent aperture 682. The vent chamber 738 provides a chamber with an increased volume capacity to lower the pressure and volume of the vapor/gas as it is expelled past the vent seal 683 but before it exits through the vent aperture 682. The vent chamber 738 has a cross-sectional area greater than a cross-sectional area of the vent aperture 682. The vent chamber 738 has a first entrance aperture 739 at one end that provides an entrance to the vent chamber 738 from the liquid receptacle 516 of the container body 512, a second exit aperture (the vent aperture 682), and a third access aperture 743 to provide access to the interior of the lid assembly 514 for the trigger 610.

In a preferred embodiment, the top drinking surface 730 of the upper lid 665 has a slight depression or well 740 that slopes downwardly from the drinking orifice 676 to the vent aperture 682. The well 740 assists to drain any remnant liquid back into the liquid receptacle 516 through the vent aperture 682. The top drinking surface 730 also has a vent deflector plate 731 adjacent the vent aperture 682. The deflector plate 731 directs vapor being expelled out of the vent aperture 682 transverse to the longitudinal axis of the container body 512 and away from the user. Specifically, the vent deflector plate 731 prevents any vapor from being directed upwardly from the vent aperture 682, and rather directs it sideways away from the user.

Figures 14, 15:
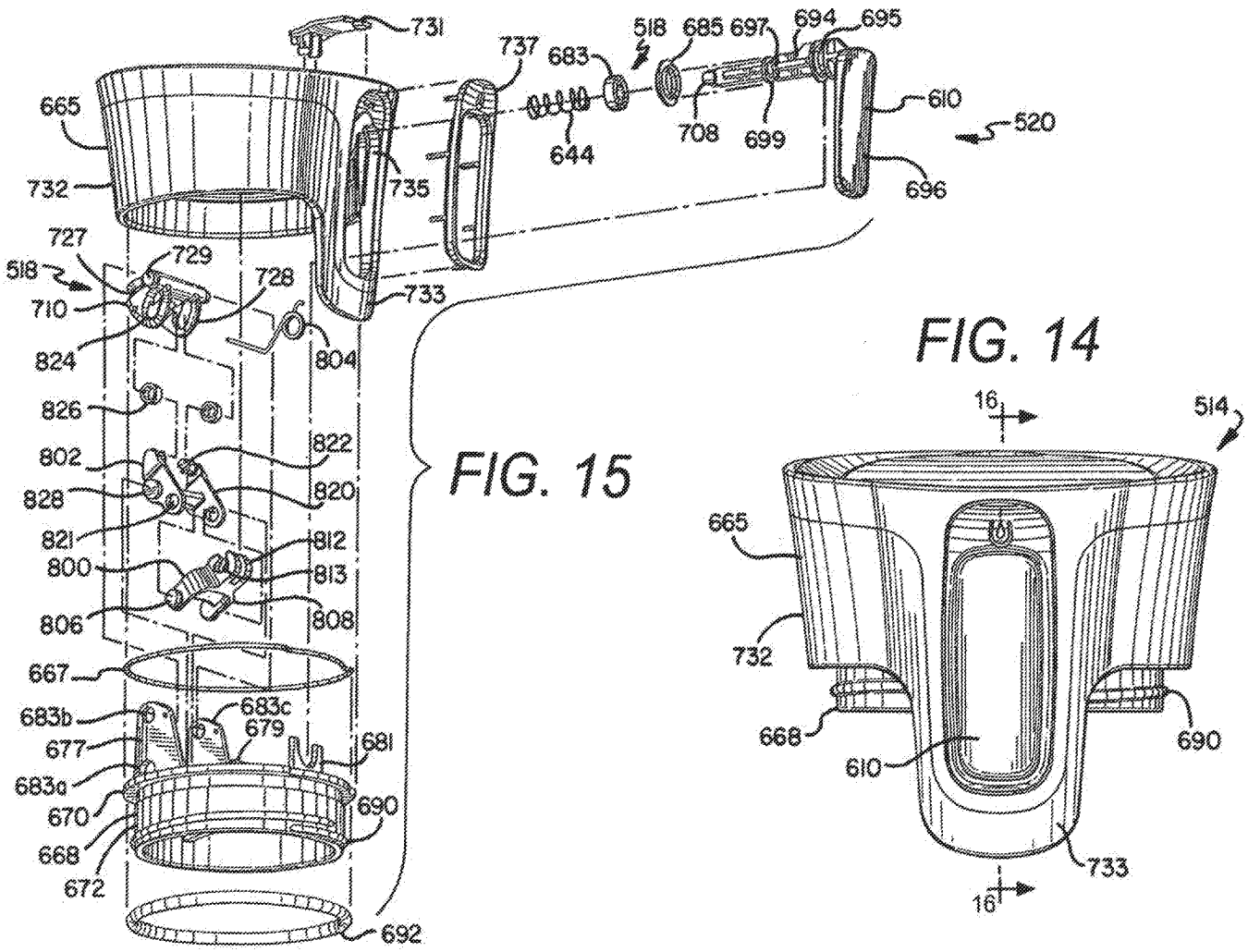
FIG. 14 is a side view of the lid of FIG. 13.
FIG. 15 is an exploded perspective view of the lid of FIG. 13.

The sidewall 732 of the upper lid 665 extends down from the drinking surface 730 toward the container body 512 when the lid assembly 514 is connected to the container body 512. As shown in FIGS. 14 and 15, a majority of the sidewall 732 extends to a generally linear termination, however, a peninsular portion 733 of the sidewall 732 adjacent the trigger 610 extends downwardly therefrom. The peninsular portion 733 of the sidewall 732 has an aperture 735 therethrough. A shroud 737 and the trigger 610 of the trigger assembly 520 are seated within the aperture 735 in the sidewall 732 of the upper lid 665.

Figure 16:
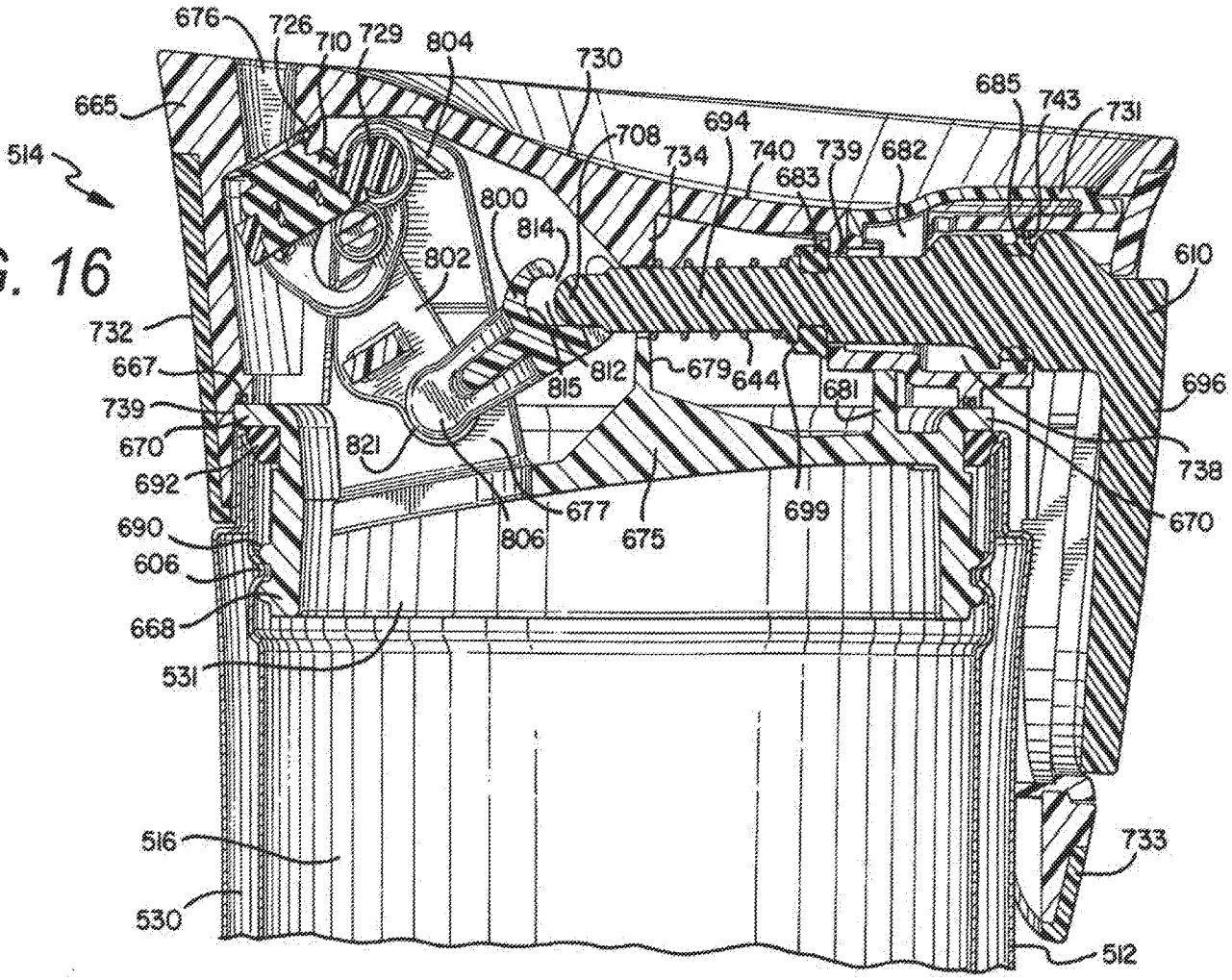
FIG. 16 is an enlarged cross-sectional view of the lid about line 16-16 of FIG. 14, when the trigger is in the normal position.
Figure 17:
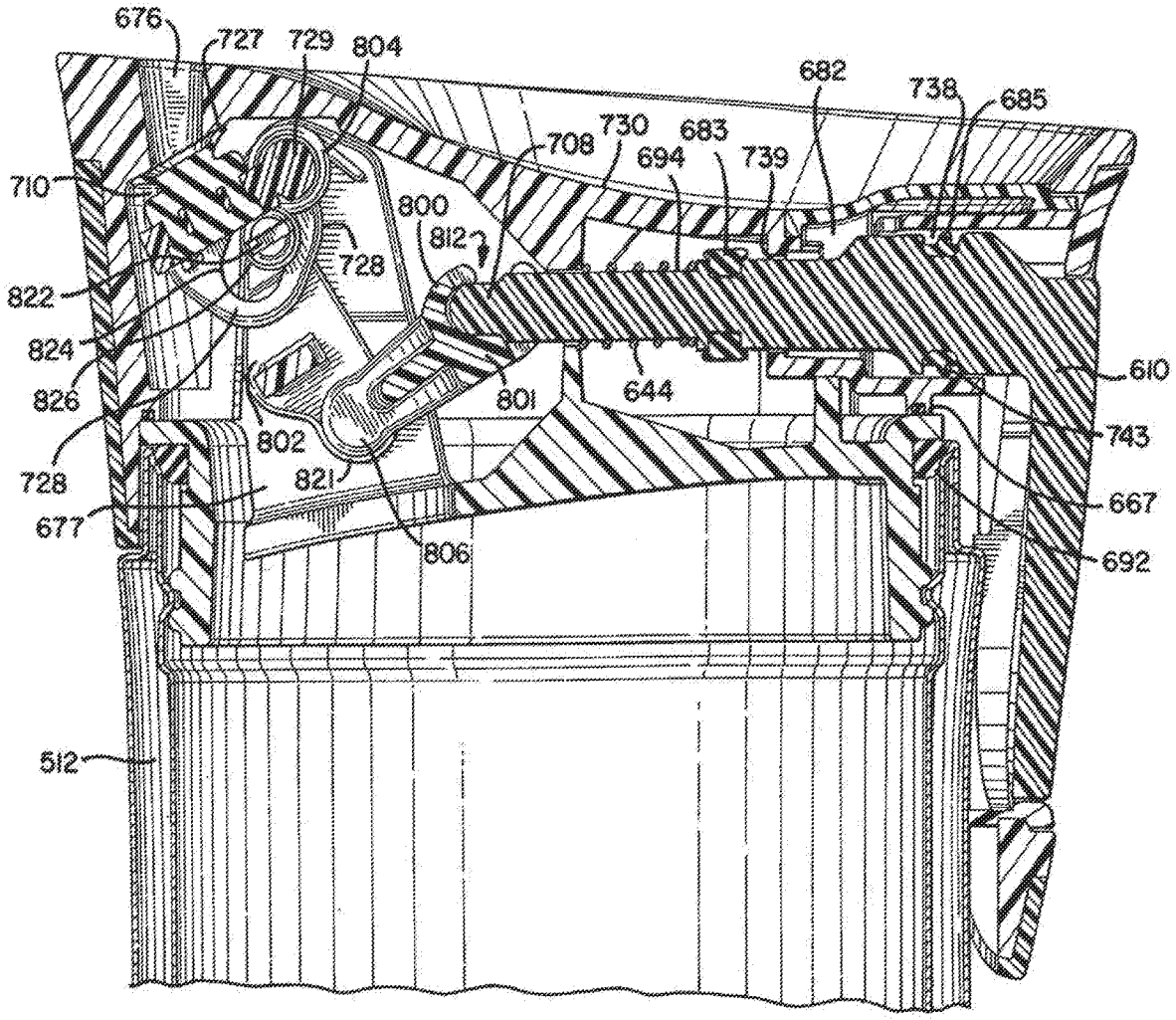
FIG. 17 is an enlarged cross-sectional view of the lid about line 16-16 of FIG. 14, when the trigger is in the semi-actuated position; and, FIG. 18 is an enlarged cross-sectional view of the lid about line 16-16 of FIG. 14, when the trigger is in the fully actuated position.
Figure 18:
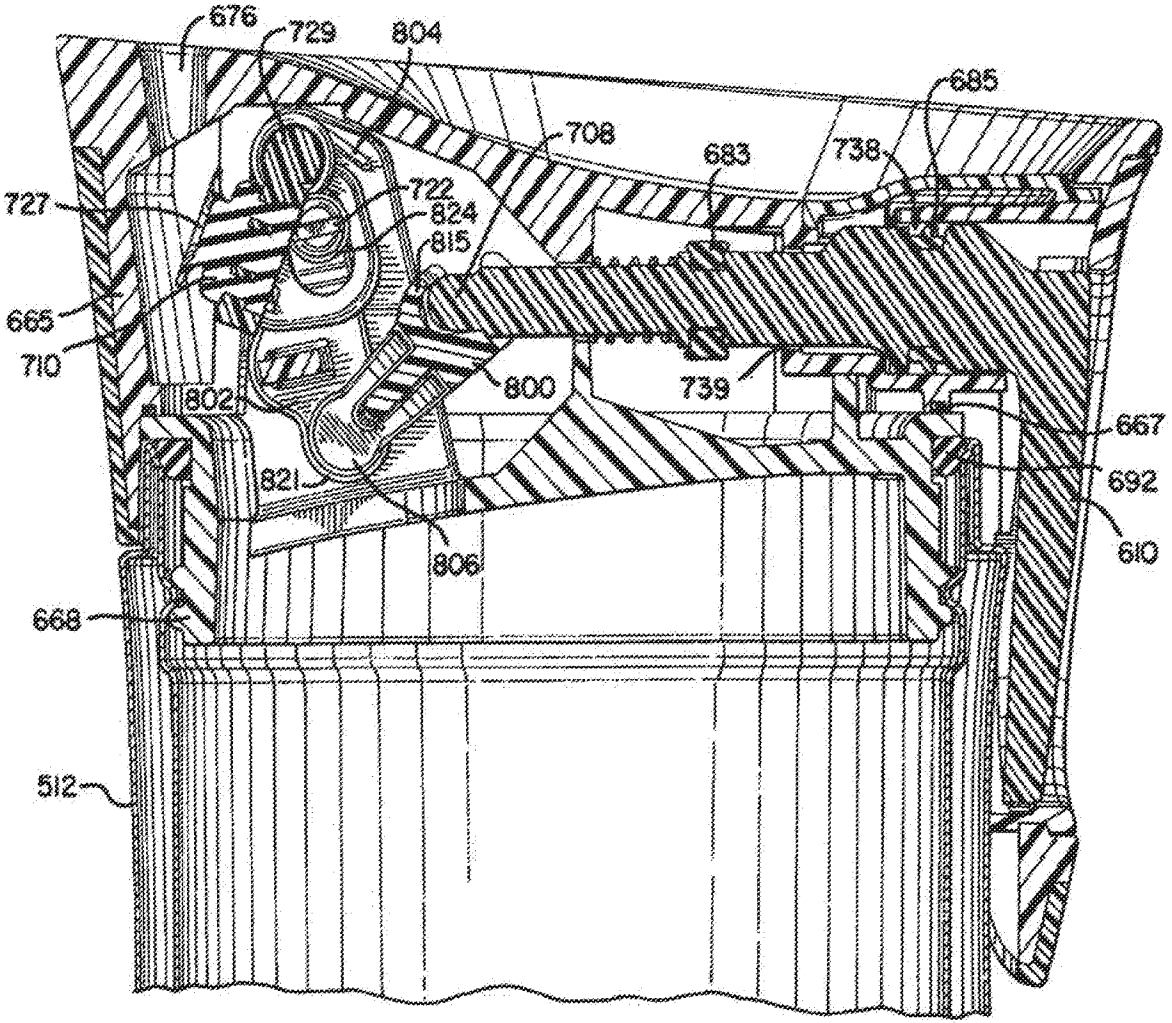

As explained above, in a preferred embodiment the upper lid 665 is fixedly connected to the lower lid 668 at a variety of locations. For example, the first support member 679 of the lower lid 668 is connected to a rib 734 extending downwardly from the underside of the top drinking surface 730 of the upper lid 665. The connection between the first support member 679 and the rib 734 is provided around the trigger 610 as shown in FIGS. 16-18. Similarly, the second support member 681 extend upwardly from the central bridge member 675 is connected to the lower portion of the vent chamber 738. Finally, the transverse flange member 670 of the lower lid member 668 is connected to an inner surface of the sidewall 732 of the upper lid 665.

To make the joint between the upper lid 665 and the lower lid 668 liquid tight, a gasket 667 is provided between the joint between the upper lid 665 and the lower lid 668. Further, in a preferred embodiment an annular shoulder 739 is provided on the interior surface of the sidewall 732 of the upper lid 665. The geometry of the annular shoulder 739 mates with the geometry of the substantially planar transverse flange member 670 that extends generally radially outwardly from the top end of the generally cylindrical sidewall portion 672 of the lower lid 668. Similarly, the gasket 667 has a similar geometry to that of the annular shoulder 739 and transverse flange member 670. The gasket 667 is provided between the annular shoulder 739 of the upper lid 665 and the transverse flange member 670 of the lower lid 668 to assist in sealing the connection between the lower and upper lids 665, 668. Thus, the gasket 667 operates as a seal to prevent liquid from escaping between the upper lid 665 and the lower lid 668.

Referring again to the components in the lid assembly 514, as best shown in FIGS. 15-18, in one embodiment the trigger 610 of the trigger assembly 520 is connected to and transitions the first linkage member 800, which operates to pivot the second linkage member 802 and ultimately pivot the shutter 710 to open and close the seal 726 to the drink opening 676. Further, as is explained herein the trigger assembly 520 also operates to move the vent seal 683 away from the entrance aperture 739 to the vent chamber 738 to operably close and open access to the container cavity 516 through the vent aperture 682, as well as a trigger seal 685 that seals the trigger 610 from the exterior of the lid assembly 514.

As shown in FIGS. 15-18, the trigger assembly 520 generally comprises a trigger member 610 and a trigger spring 644. In one embodiment the trigger 610 is generally L-shaped with a main body portion 694 and a transverse portion 696 extending downwardly therefrom. Moreover, in a preferred embodiment the main body portion 694 has a shaft-like shape. The trigger 610 also has a pair of arms 708 at an end of the main body portion 694 that engages the first linkage member 800 to operably open and close the shutter 710 to alternately open and seal the drink orifice 676.

The main body portion 694 of the trigger 610 extends through the access aperture 743 and into the vent chamber 738 of the lid assembly 514. A portion of the main body portion 794 of the trigger 610 is generally housed within the vent chamber 738, and a portion of the main body portion 794 of the trigger 610 extends out of the vent chamber 738, through the entrance aperture 739 to the vent chamber 738, and into the cavity of the lid assembly 514.

In a preferred embodiment the trigger 610 also seats several seals, including the trigger seal 685 and the vent seal 683. As shown in FIGS. 16-18, the trigger seal 685 and the vent seal 683 are both seated on the main body portion 694 of the trigger 610. Since the trigger 610 extends through the access aperture 743 and into the vent chamber 738, the trigger seal 685 is required to seal this opening 743 once the trigger 610 is inserted into the lid assembly 514. Specifically, in a preferred embodiment the interior of the vent chamber 738 has a cylindrical shape and thus the trigger seal 685 is a type of wiper O-ring that is seated in an arcuate recess 695 on the main body portion 694 of the trigger 610. Thus, the trigger seal 685 operates as a wiper seal contacting the interior surface of the vent chamber 738 to seal the area between the interior surface of the vent chamber 738 and the trigger 610 to prevent any liquid or vapor from escaping out of the vent chamber 738 through the access aperture 743. The trigger seal 685 is positioned on the trigger 610 between the vent aperture 682 and the access aperture 743. In this manner the trigger seal 685 also operates as an end wall for the vent chamber 738.

The vent seal 683 is also seated on the main body portion 694 of the trigger 610. Like the trigger seal 685 the vent seal 683 is seated in another arcuate recess 697 on the main body portion 694 of the trigger 610. This recess 697, however, is positioned outside of the vent chamber 738 and adjacent the entrance aperture 739 to the vent chamber 738. Accordingly, in this manner the vent seal 683 operates to seal the entrance 739 to the vent chamber 738 in a first normal position, as shown in FIG. 16, and to open the entrance 739 to the vent chamber 738 in the both the intermediate actuated position of FIG. 17 and the second or fully actuated position of FIG. 18.

A shoulder 699 is provided on the main body portion 694 of the trigger 610 adjacent the arcuate recess 697 for the vent seal 683. The shoulder 699 operates as a surface for the trigger spring 644 to exert a force on the trigger 610. In a preferred embodiment the trigger spring 644 is a compression spring that has a first end contacting the combination of the first support member 679 of the lower lid 668 and the rib 734 of the upper lid 665, and a second end contacting the shoulder 699 of the trigger 610. Since the first end of the trigger spring 644 is fixed in place, the second end of the trigger spring 644 exerts a force on the trigger 610 in an attempt to maintain the trigger 610 in the normal or unactuated position (see FIGS. 13 and 16). In this position the vent seal 683 is pushed up against the outside of the vent chamber 738 at the entrance 739 thereto, effectively sealing the entrance 739 to the vent chamber 738 to preclude any liquid or vapor from being to escape out of the cavity 516 of the drinking container 510.

The transverse portion 696 of the trigger member 610 is fixedly connected to and preferably integral with the main body portion 694 of the trigger member 610. Thus, the transverse portion 696 operates as a push-button actuator to actuate the trigger mechanism 520 and sealing mechanism 518. In a preferred embodiment, the transverse portion 696 of the trigger member 610 has a shape that generally matches the aperture 735 in the peninsular portion 733 of the sidewall 732 of the upper lid member 665. The transverse portion 696 is moveable from a first normal or non-actuated position shown in FIG. 16, to a partially actuated position shown in FIG. 17 and a fully actuated position show in FIG. 18. In the partially actuated position (FIG. 17) the vent seal 683 is in the open position allowing vapor and internal pressure to be released through the entrance aperture 739 and to exit out the vent orifice 682, but the shutter 710 is closed sealing the drinking orifice 676. In the fully actuated position (FIG. 18) both the vent seal 683 and shutter 710 are in the open position allowing liquid to be expelled out the drinking orifice 676 and allowing vapor and pressure to continue to be released from the vent opening 682. The trigger mechanism 520 can be actuated by exerting a generally radially inward force on the trigger member 610 to overcome the opposite force of the trigger spring 644 to push the trigger member 610 radially inward in the lid assembly 514.

As explained above and shown in the Figures, the trigger 610 is mechanically connected to the shutter 710 through the first and second linkage members 800, 802. In one embodiment, the arms 708 at the end of the main body portion 694 of the trigger 610 engage the first linkage member 800 to operably open and close the shutter 710 to seal the drink orifice 676. Similarly, the trigger 610 is mechanically connected to the vent seal 683.

In one embodiment, the first linkage member 800 has a body portion 808 with a pair of outwardly extending arms 806 at one end of the body portion 808 and a slot 812 at an opposing end of the body portion 808. The arms 806 each have a tab 810 extending outwardly therefrom that rotatably engage the second linkage member 802.

The slot 812 in the opposing end of the body portion 808 of the first linkage member 800 is designed to engage the arms 708 of the trigger 610. Further, the slot 812 has an opening 814 to allow the arms 708 of the trigger 610 to be fitted within the slot 812. The slot 812 is sized such that when the trigger 610 is in both (a) the normal or non-actuated position (see FIG. 16), as well as (b) the partially actuated position (see FIG. 17), the shutter 710 and seal 726 on the shutter 710 are in the closed position preventing liquid from escaping through the drinking orifice 676. In the partially actuated position, however, the vent seal 683 is open. The slot 812 is also sized such that when the trigger 610 is in the fully actuated position (see FIG. 18), the shutter 710 and the seal 711 on the shutter 710 are in the open position to allow liquid to escape through the drinking orifice 676. Accordingly, the slot 812 operates as a cam track for the arms 708 of the trigger 610.

As best shown in FIGS. 16-18, the shape and size of the slot 812 in connection with the shape of the main body portion 694 of the trigger 610 and the stroke length of the trigger 610 determine when the shutter 710 will be actuated. The actuation stroke of the trigger mechanism 520 is defined as the movement of the trigger 610 a distance between the normal or closed position (see FIG. 16) and the fully actuated position (see FIG. 18). In the normal or closed position the arms 708 of the trigger 610 are in a first position in the slot 812 of the first linkage member 800, generally toward or touching one end wall 813 of the slot 812. In the second or partially actuated position (from 0 mm of travel to approximately 1 mm. of travel of the trigger 610 from the normally closed position) the arms 708 are positioned in the slot 812 between the first slot wall 813 and the second slot wall 815. In the actuated position (from approximately 1 mm. of travel to approximately 2 mm. of travel of the trigger 610) the arms 708 contact the second slot wall 815 and transition the first linkage member 800 to operably open the shutter 710. The trigger 610 does not transition the first linkage member 800 until the arms 708 of the trigger 610 engage the second wall 815 of the slot 812. Accordingly, during the first portion of the actuation stroke the vent seal 683 opens first, and then the shutter 710 will open as described below during the second portion of the actuation stroke. This provides a built-in delay to allow the internal pressure and vapor to escape out of the vent opening and be dispersed by the vent shield rather than spurting out the drink orifice and at the user.

The first linkage member 800 is connected to the second linkage member 802. Like the first linkage member 800, the second linkage member 802 has a body portion 820 with a first end and a second end. The first end of the second linkage member 802 has a pair of apertures 821 to rotatably retain the tabs 806 of the first linkage member 800, and the second end of the second linkage member 802 has a pair of inwardly extending tabs 822 that operably engage a cam track 824 on the shutter 710. A roller member 826 is provided on each tab 822 to allow the tabs 822 of the second linkage member 802 to engage the shutter 710 with less resistance. As is explained herein, the tabs 822 with the roller members 826 operate as cams within a cam track of the shutter 710. Finally, a pair of outwardly extending pivot tabs 828 extend from the body portion 820 of the second linkage member 802, generally between the apertures 821 and the tabs 822.

The pivot tabs 828 of the second linkage member 812 are fitted within the first set of apertures 683*a* in the gusset walls 677 of the lower lid member 668. Accordingly, the second linkage member 802 is able to rotate about the pivot tabs 828 when they are fitted in the first set of apertures 683*a*.

To connect the first linkage member 800 to the second linkage member 802 the arms 806 of the first linkage member 800 are fitted within the apertures 821 of the second linkage member 802. The arms 806 are generally free to rotate within the apertures 821 of the second linkage member 802. As the trigger member 610 actuates or moves laterally from the normal position to the actuated position, the end of the first linkage member 800 having the slot 812 moves somewhat laterally with the trigger member 610. During this movement the first linkage member 800 is also able to partially rotate about the arms 708 of the trigger 610. As the end of the first linkage member 800 having the slot 812 is transitionally laterally, the opposing end of the first linkage member 800 pivotally connected to the second linkage member 802 is transitioned downwardly. This movement is controlled by the pivot connection of the second linkage member 802 with the gusset walls 677 of the lower lid member 668. Due to the pivot connection between the pivot tabs 828 on the second linkage member 802 with the apertures 683 in the gusset walls 677, the second linkage member 802 is restrained to pivoting about its pivot tabs 828. Thus, the second linkage member 802 generally pivots clockwise when moving from the normal position to the actuated position as shown in FIGS. 16-18 due to the force applied by the first linkage member 800 through the trigger 610.

Concurrently, as the first end of the second linkage member 802 connected to the first linkage member 800 is pivoted or rotated clockwise downwardly, the opposing second end of the second linkage member 802 having the inwardly extending tabs 822 is similarly pivoted or rotated clockwise upwardly to actuate the shutter 710 as explained herein. Accordingly, the shutter 710 is mechanically connected to the trigger 610 through the first and second linkage members 800, 802.

In a preferred embodiment the shutter 710 operates as a closing member and seal for the drinking orifice 676 in the upper lid 665. In one embodiment the shutter 710 has a pair of shutter arms 728, a pair of pivot members 729, and a resilient seal 727, preferably made of silicon or some other resilient material. The shutter arms 728 have a slotted cam track 824 that retain the tabs 822 and roller members 826 of the second linkage member 802. The pivot members 729 of the shutter 710 are pivotally retained in the second set of apertures 683*b* of the gusset walls 677 of the lower lid member 668. Accordingly, the shutter 710 is limited to pivoting (generally counter clockwise when transitioning from the normal to the actuated position, and clockwise when transitioning back to the normal position as shown in FIGS. 16-18) about its pivot members 729 in the apertures 683*b* of the gusset wall 677. The seal 727 is positioned on the shutter 710 such that in the normal position the seal 727 of the shutter 710 fluidly closes the drinking opening 676.

Movement of the shutter 710 is thus controlled by the trigger mechanism 520. As explained herein, the trigger 610 transitions the first linkage member 800 which in turn transitions the second linkage member 802. As the second linkage member 802 is transitioned from its normal to its actuated position the rollers 826 on the tabs 822 of the second linkage member 802 pivot with the second linkage member 802. Since the rollers 826 are positioned within the cam track 824 of the shutter arms 728, the shutter 710 likewise pivots counter-clockwise about its pivot members 729 to change the angular orientation of the shutter 710 and accordingly open the drinking orifice 676 in the actuated position.

The torsion spring 804 has a first end positioned in one of the apertures 683*c* on the gusset wall 677, and a second end that engages the shutter 710. The torsion spring 804 exerts a force on the shutter 710 to retain the shutter 710 in the closed or normal position. When a force and sufficient lateral translation movement are applied to the trigger 610 sufficient to overcome the spring force of the torsion spring 804 (as well as the spring force of the trigger spring) the shutter 710 will open. The shutter spring 804, however, will exert a force to close the shutter 710 to seal the drinking opening 676 once the force on the trigger 610 is removed. In one embodiment a silicon seal is overmolded on the upper surface of the shutter 710 for sealing the drinking orifice 676 when the shutter 710 is in the closed position. Accordingly, the shutter 610 operates to operably close and open access to the container cavity through the drinking orifice 676.

In sum, the shutter 710 and the vent seal 683 are normally in the closed position. The trigger 610, however, operates to independently move the shutter 610 and the vent seal 683 from the closed or normal position to the open position following appropriate actuation of the trigger mechanism. The actuation of the trigger 610 occurs in a two-part actuation stroke wherein the trigger 610 moves from its first position to its second position. During the first part of the actuation stroke the vent seal 683 is transitioned from the normal or closed position to the actuated or open position to open access to the vent chamber 738 and the vent orifice 682. During the first part of the actuation stroke the shutter 710 remains closed. During the second part of the actuation stroke the shutter 710 is transitioned from the normal or closed position to the actuated or open position to open the drinking orifice 676. Further, the actuation occurs through lateral movement of the trigger 610 in a transverse direction to the longitudinal axis of the container body 512.

When the user is done drinking, the user releases the trigger 610 and the sealing assembly 514, including the shutter 710 and the vent seal 683, automatically close and return to the normal position due to the spring force of the trigger spring and the shutter spring.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number. Additionally, the term "having" as used herein in both the disclosure and claims, is utilized in an open-ended manner.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention and the scope of protection is only limited by the scope of the accompanying Claims.

What is claimed is:

1. A drinking container comprising:

a container body having a cavity and defining a longitudinal axis; and a lid assembly configured to cover the cavity, the lid assembly including:

a lid body including a top surface and at least one side surface, the lid body defining a vent aperture and a drink aperture, the drink aperture extending through the top surface;

a shutter configured to block the drink aperture in the top surface;

a vent seal configured to prevent fluid communication between the vent aperture and the cavity; and a push-button trigger supported by the side surface of the lid body and positioned on an opposite side of the longitudinal axis from the drink aperture, the push-button trigger having a linear actuation stroke translating in a straight line transverse to the longitudinal axis and a touch surface oriented perpendicular to the linear actuation stroke; and the push-button trigger being mechanically connected to the shutter and the vent seal and configured to open and close the shutter and vent seal during the linear actuation stroke, wherein the vent seal is initially actuated during a first portion of the linear actuation stroke of the push button, wherein the linear actuation stroke passes through a vertical plane passing through a portion of the shutter, the vent seal, and the push-button trigger; and wherein the shutter is initially actuated during a second portion of the linear actuation stroke of the push-button trigger.

2. The drinking container of claim 1, wherein the longitudinal axis defines a central axis of the container body and lies within the vertical plane.

3. The drinking container of claim 2, wherein the vertical plane bisects the shutter, the vent seal, and the push-button trigger.

4. The drinking container of claim 3, wherein the vent aperture is located on the top surface of the lid body.

5. The drinking container of claim 3, further comprising a vent chamber between the vent seal and the vent aperture.

6. The drinking container of claim 5, wherein the trigger extends at least partially through the vent chamber.

7. The drinking container of claim 5, wherein the vent chamber has a cross-sectional area greater than a cross-sectional area of the vent aperture.

8. The drinking container of claim 3, further comprising:

a first spring member connected to the shutter and exerting a force on the shutter towards a closed position, and a second spring member connected to the push-button trigger and exerting a force on the push-button trigger to move the vent seal towards a closed position.

9. The drinking container of claim 8, wherein the shutter moves transverse to the straight line translation of the linear actuation stroke of the push-button trigger upon movement of the shutter from a closed to an open position.

10. The drinking container of claim 9, further comprising:

a vent chamber between the vent seal and the vent aperture, wherein the push-button trigger extends at least partially through the vent chamber.

11. The drinking container of claim 10, wherein the vent chamber has a cross-sectional area greater than a cross-sectional area of the vent aperture.

12. The drinking container of claim 11, wherein the push-button trigger translates in a straight line transverse to the longitudinal axis in response to a generally perpendicular force applied to the touch surface.

13. The drinking container of claim 12, wherein the vent aperture extends through the top surface of the lid body.

* * * * *